US011155108B2

(12) United States Patent
Arakawa

(10) Patent No.: US 11,155,108 B2
(45) Date of Patent: Oct. 26, 2021

(54) IMAGE RECORDING APPARATUS

(71) Applicant: BROTHER KOGYO KABUSHIKI KAISHA, Nagoya (JP)

(72) Inventor: Yuta Arakawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/003,666

(22) Filed: Aug. 26, 2020

(65) Prior Publication Data

US 2021/0070072 A1 Mar. 11, 2021

(30) Foreign Application Priority Data

Sep. 10, 2019 (JP) ..... JP2019-164636

(51) Int. Cl.

| | |
|---|---|
| ***B41J 11/14*** | (2006.01) |
| ***B41J 11/06*** | (2006.01) |
| ***B41J 11/04*** | (2006.01) |
| ***B41J 25/00*** | (2006.01) |
| ***B41J 11/00*** | (2006.01) |

(52) U.S. Cl.

CPC ..... *B41J 11/04* (2013.01); *B41J 11/006* (2013.01); *B41J 25/006* (2013.01)

(58) Field of Classification Search

CPC . B41J 25/00; B41J 11/04; B41J 25/006; B41J 13/025; B41J 11/06; B41J 11/006; B41J 13/02; B41J 13/03; B41J 13/036; B41J 13/042; B41J 13/048

See application file for complete search history.

(56) References Cited

U.S. PATENT DOCUMENTS

| | | | | |
|---|---|---|---|---|
| 2013/0293656 | A1 | 11/2013 | Anami | |
| 2014/0232800 | A1 | 8/2014 | Sano et al. | |
| 2015/0145917 | A1* | 5/2015 | Motoyama | B41J 11/006 347/16 |
| 2016/0289023 | A1 | 10/2016 | Uchino | |
| 2021/0070576 | A1* | 3/2021 | Arakawa | B65H 29/125 |

FOREIGN PATENT DOCUMENTS

| | | | |
|---|---|---|---|
| JP | 2013-230921 | A | 11/2013 |
| JP | 2014-156088 | A | 8/2014 |
| JP | 2014-156333 | A | 8/2014 |
| JP | 2015-066934 | A | 4/2015 |
| JP | 2016-193547 | A | 11/2016 |

OTHER PUBLICATIONS

Machine translation of JP 2015-066934, published on Apr. 2015.*

* cited by examiner

*Primary Examiner* — Huan H Tran
(74) *Attorney, Agent, or Firm* — Baker Botts L.L.P.

(57) ABSTRACT

An image recording apparatus includes: a casing having an internal space; a conveying passage formed inside the casing; a first roller pair positioned in the conveying passage, having a driving roller and a driven roller, and configured to pinch a sheet and to convey the sheet in a conveying orientation; a platen positioned on a downstream side in the conveying orientation of the first roller pair, and having a supporting surface supporting the sheet; a recording part positioned above the platen and configured to record an image on the sheet supported by the platen; a second roller pair which is located on the downstream side in the conveying orientation of the supporting surface of the platen, and which is configured to pinch the sheet and to convey the sheet; and a moving mechanism configured to move the platen to a printing position and to a release position.

12 Claims, 29 Drawing Sheets

IMAGE RECORDING APPARATUS

CROSS REFERENCE TO RELATED APPLICATION

The present application claims priority from Japanese Patent Application No. 2019-164636, filed on Sep. 10, 2019, the disclosure of which is incorporated herein by reference in its entirety.

BACKGROUND

Field of the Invention

The present disclosure relates to an image recording apparatus which records an image on a sheet.

Description of the Related Art

Regarding an image recording apparatus, in a case that a sheet is jammed in the inside of a casing of the image recoding apparatus, the sheet is removed from the inside of the casing by allowing a user to access the sheet from the outside of the casing.

For example, Japanese Patent Application Laid-open No. 2015-66934 discloses a printer wherein a platen facing (opposed to) a recording part which records an image on a sheet and supporting the sheet is rockable or pivotable. In this printer, in a case that the sheet is jammed between the recording part and the platen, a controller controls the rocking (pivoting) of the platen from a reference position to a release position so as to provide a state that a sheet conveying passage of the sheet is widely open, thereby making it possible to take out the sheet easily.

SUMMARY

A roller pair configured to convey the sheet is arranged in the inside of the image recording apparatus. In a case that the sheet is pinched or held by the roller pair, and that the platen is rocked to the release position and the sheet is taken out, the load applied when the sheet is taken out becomes large. Further, there is such a fear that, when the sheet is taken out, the sheet might be broken or torn and that a part of the sheet might remain in the inside of the image recording apparatus.

The present disclosure has been made in view of the above-described situation, and an object of the present disclosure is to provide an image recording apparatus capable of easily taking out a sheet jammed or clogged between the platen and the recording part.

According to an aspect of the present disclosure, there is provided an image recording apparatus including:

a casing having an internal space which is released to outside via an opening;

a conveying passage via which a sheet is conveyed and which is formed, inside the casing, at a position opposite to the opening with respect to the internal space;

a first roller pair which is positioned in the conveying passage, which has a driving roller and a driven roller following the driving roller, and which is configured to pinch the sheet and to convey the sheet in a conveying orientation toward the internal space;

a platen which is positioned, in the conveying passage, on a downstream side in the conveying orientation of the first roller pair, and which has a supporting surface supporting the sheet;

a recording part which is positioned above the platen and which is configured to record an image on the sheet supported by the platen;

a second roller pair which is positioned, in the conveying passage, on the downstream side in the conveying orientation of the supporting surface of the platen, and which is configured to pinch the sheet and to convey the sheet; and a moving mechanism configured to move the platen to a printing position and to a release positon, the printing positon being a position at which the platen is located under a condition that the image is recorded on the sheet by the recording part, and the release position being a position at which an end part, in the conveying orientation, of the supporting surface is positioned below a position of the end part at the printing position and a space between the platen and the recording part is communicated with the internal space via a gap between the end part and the second roller pair, wherein the first roller pair is configured to be changeable to a nipping state in which the driving roller and the driven roller make contact with each other, and to a separated state in which the driving roller and the driven roller are separated from each other, and the moving mechanism is configured to change the state of the first roller pair to the nipping state under a condition that the platen is at the printing position, and to change the state of the first roller pair to the separated state under a condition that the platen is at the release position.

In the case that the sheet jammed between the recording part and the platen is taken out, the platen is moved to the release position. In this situation, the first roller pair is in the separated state. Accordingly, the sheet jammed between the platen and the recording part can be easily taken out.

DESCRIPTION OF THE EMBODIMENTS

Figure 1:
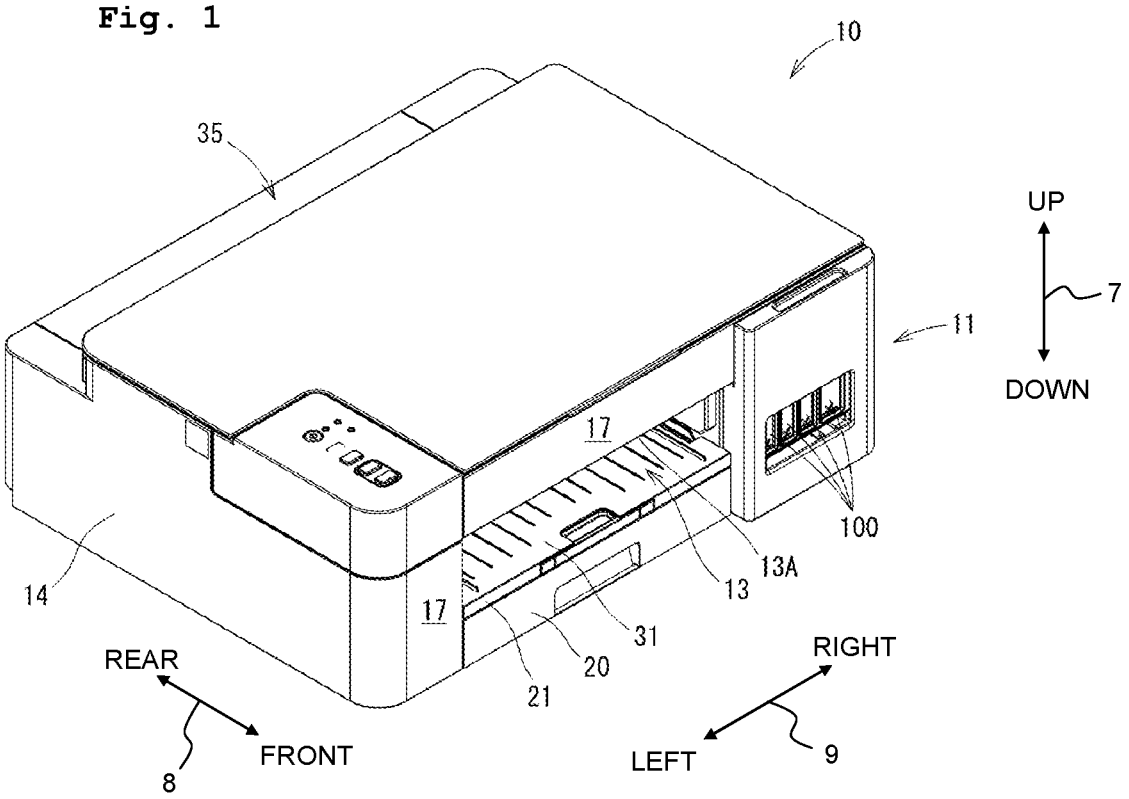
FIG. 1 is a perspective view depicting a multifunction peripheral including a printer part as an image recording apparatus according to an embodiment of the present disclosure.

An explanation will be made below, while appropriately referring to the drawings, about an embodiment of the present disclosure. Note that the embodiment explained below is merely an example of the present disclosure. It goes without saying that the embodiment of the present disclosure can be appropriately changed within a range without changing the gist or essential characteristics of the present disclosure. In the following explanation, an up-down direction 7 is defined on the basis of a state (state depicted in FIG. 1) in which a multifunction peripheral 10 is usably installed. A front-rear direction 8 is defined assuming that a plane, in which an opening 13 is provided, is defined as a front side (front surface 17). A left-right direction 9 (an example of a "scanning direction") is defined as viewing the multifunction peripheral 10 from the front side (side of the front surface 17). The up-down direction 7, the front-rear direction 8, and the left-right direction 9 are orthogonal to one another. Note that "upward orientation" is a component of the up-down direction 7, and "downward orientation" is also a component of the up-down direction 7. Similarly, a "frontward orientation" and a "rearward orientation" are components, respectively, of the front-rear direction 8; a "rightward orientation" and a leftward orientation" are components, respectively, of the left-right direction 9.

<Overall Structure of Multifunction Peripheral 10>

As depicted in FIG. 1, the multifunction peripheral 10 is provided with a casing 14 which is generally formed into a thin type rectangular parallelepiped. The multifunction peripheral 10 has various functions including, for example, a print function and a scan function. The print function is a function of recording an image on one surface of a sheet 12 (see FIG. 2, example of a "sheet") in accordance with the ink-jet system. The multifunction peripheral 10 may be configured to record images on both surfaces of the sheet 12. A printer part 11 (example of an "image recording apparatus") is provided at a lower portion of the casing 14 in order to realize the print function. A scanner part 35 is provided at an upper portion of the casing 14 in order to realize the scan function.

The casing 14 is an exterior cover for accommodating therein the respective constitutive elements of the printer part 11 and the scanner part 35. The casing 14 covers a base member 90 (see FIG. 3), which will be described later on, from an upper position of the base member 90.

Figure 2:
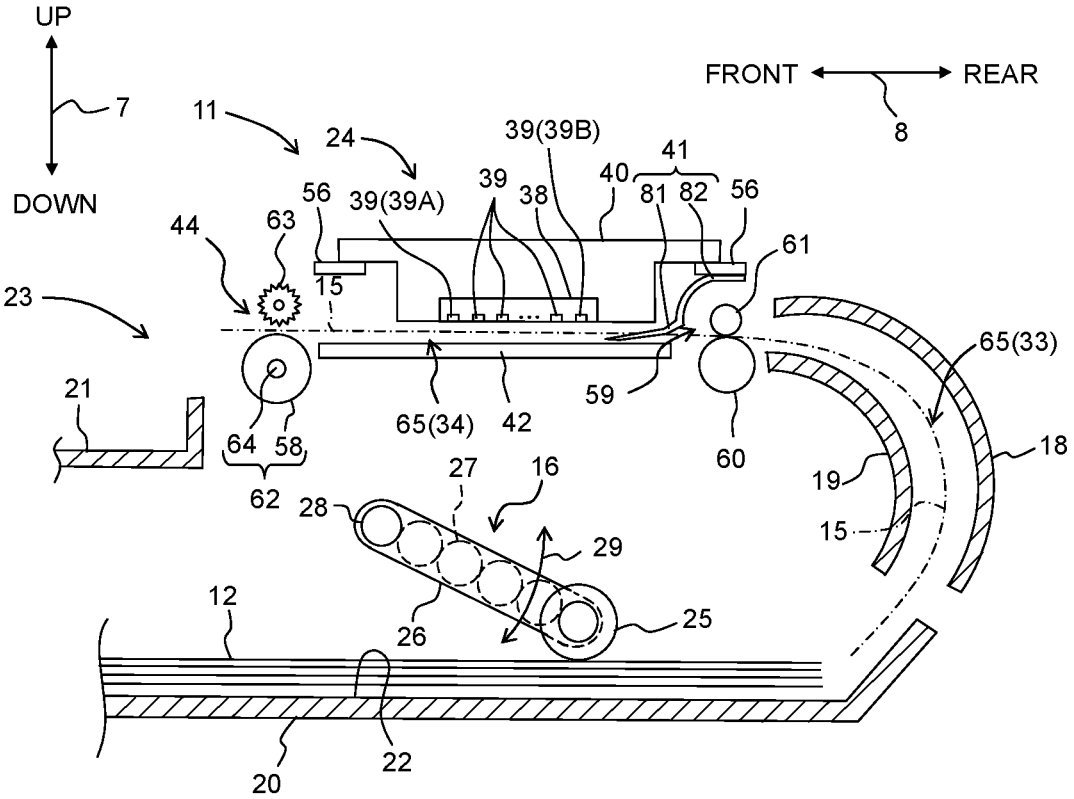
FIG. 2 is a vertical cross-sectional view schematically depicting the internal structure of the printer part.
Figure 3:
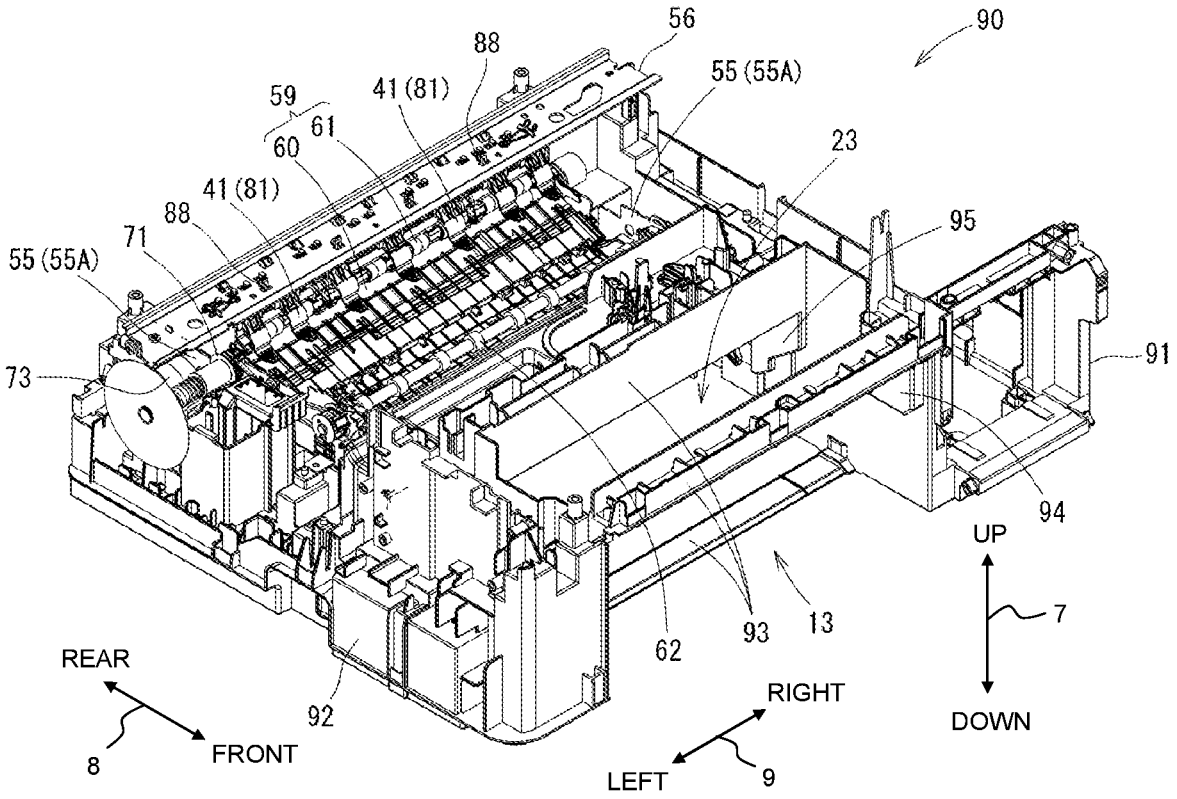
FIG. 3 is a perspective view depicting a lower portion of the printer part.
Figure 5:
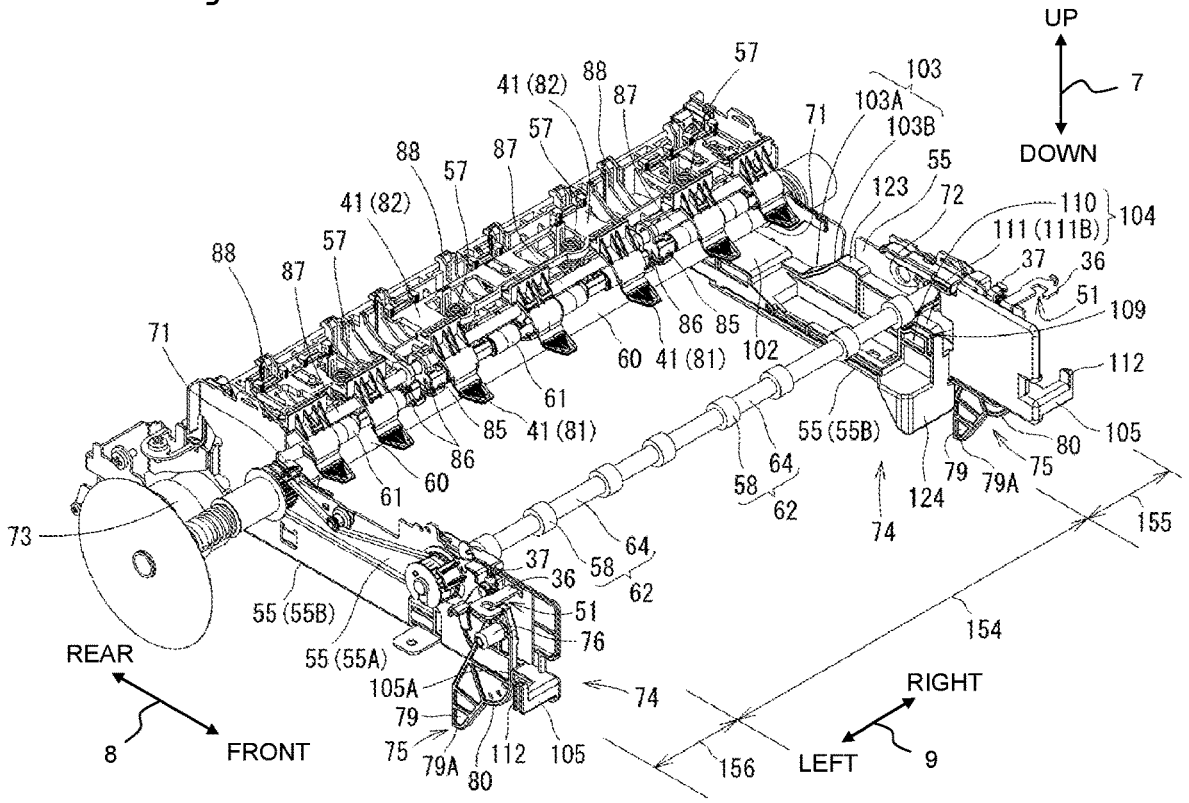
FIG. 5 is a perspective view depicting a conveying roller, a discharge roller, a roller holder, a side frame, a slide member, and those in the vicinity thereof.
Figure 11:
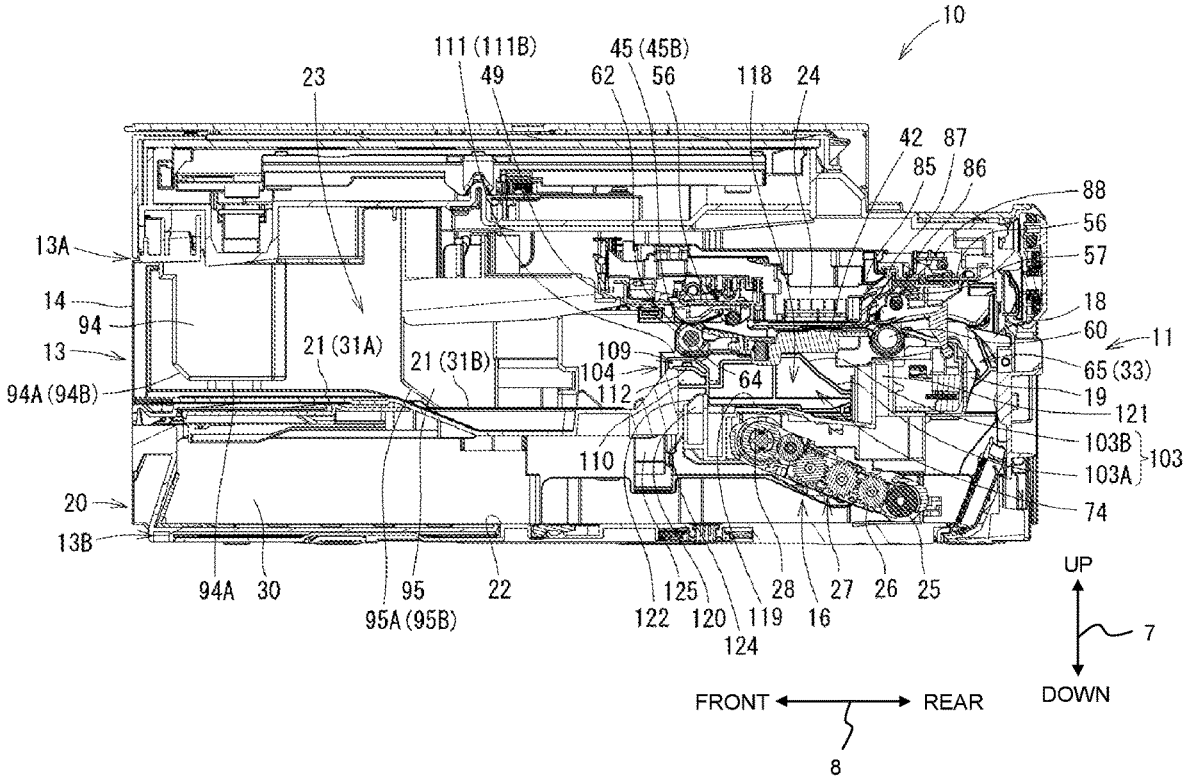
FIG. 11 is a vertical cross-sectional view taken along the center in the left-right direction of the printer part in a state that the feed tray is installed.

As depicted in FIGS. 2 and 3, the printer part 11 is provided with, as constitutive elements thereof, a feed tray 20 (example of a "tray"), a discharge tray 21, a feeding part 16, a conveying passage 65, a base member 90, a pair of side frames 55 (example of a "frame"), a recording part 24, guide rails 56, a conveying roller pair 59 (example of a "first roller pair"), a discharge roller pair 44 (example of a "second roller pair"), a contact member 41, a platen 42, and an interlocking mechanism. As depicted in FIG. 5, the interlocking mechanism is provided with slide members 74, levers 75 and coil springs 115. As depicted in FIGS. 2, 3 and 11, the feeding part 16, the conveying passage 65, the pair of side frames 55, the recording part 24, the guide rails 56, the conveying roller pair 59, the discharge roller pair 44, the contact member 41, the platen 42, and the interlocking mechanism are positioned at the inside of the casing 14.

<Feed Tray 20>

As depicted in FIG. 1, the opening 13 is formed in the front surface 17 of the casing 14. As depicted in FIG. 3, the casing 14 has an internal space 23. The internal space 23 is open to the outside (space disposed in front of the casing 14) via the opening 13.

By inserting the feed tray 20 to the rear side (in the rearward orientation), it is possible to install the feed tray 20 to the casing 14. FIG. 1 depicts a state in which the feed tray 20 is installed to the casing 14. The feed tray 20, which is installed to the casing 14, can be pulled out or withdrawn from the casing 14 by being moved to the front side (in the frontward orientation) via the opening 13 (see FIG. 4). The rearward orientation is an example of a "first orientation". The frontward orientation (opposite to the rearward orientation) is an example of a "second orientation".

Figure 4:
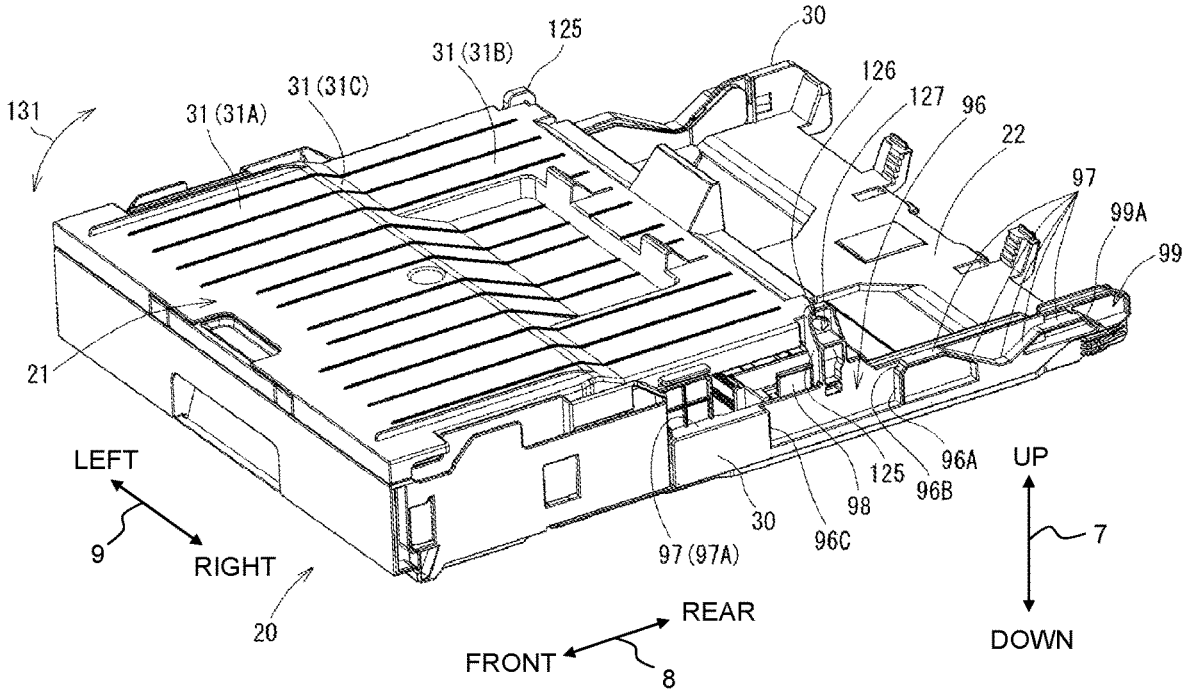
FIG. 4 is a perspective view depicting a feed tray and a discharge tray.

As depicted in FIG. 4, the feed tray 20 is a box-shaped member having an upper portion which is open. The feed tray 20 is provided with a bottom wall 22 and a pair of side walls 30.

As depicted in FIG. 2, a plurality of pieces of the sheet 12 are supported by the bottom wall 22 in a stacked state. Note that the sheet 12 is omitted from the illustration in the respective drawings which are different from FIG. 2.

As depicted in FIG. 4, the bottom wall 22 supports a pair of side guides 98 which are movable in the left-right direction 9. Note that FIG. 4 depicts only a side guide 98 on the right side (right side guide 98) of the pair of side guides 98, and a side guide 98 on the left side (left side guide 98) of the pair of side guides 98 is hidden by the discharge tray 21. A right end of the sheet 12 supported by the bottom wall 22 makes contact with (abuts against) the left surface of the right side guide 98. A left end of the sheet 12 supported by the bottom wall 22 makes contact with the right surface of the left side guide 98. The pair of side guides 98 are connected to one another so that the pair of side guides 98 are interlockable with each other. When one of the pair of side guides 98 is moved rightwardly or leftwardly, the other is interlocked and moved leftwardly or rightwardly.

As depicted in FIG. 4, the pair of side walls 30 are provided upstandingly in the upward direction from a right end and a left end of the bottom wall 22. The pair of side walls 30 extend in the front-rear direction 8. The pair of side walls 30 are contacted by the levers 75 (see FIG. 5) in the feed tray 20. The pair of side walls 30 are positioned under or below an upper end 13A of the opening 13 (see FIG. 11).

In the pair of side walls 30, recesses 99 which are recessed downwardly from the upper surface 97 are formed at rear end portions thereof, respectively. An inclined surface 99A, which comparts a front end of the recess 99, is inclined upwardly toward the front.

The pair of side walls 30 have cutouts 96 on outer sides thereof in the left-right direction 9. In other words, inner side portions in the left-right direction 9 of the pair of side walls 30 are not cut out. The pair of side walls 30 are provided with projected parts 125 which project or protrude upwardly and which are disposed at the positions not subjected to the cutting out. The projected parts 125 support the discharge tray 21.

The cutouts 96 are recessed downwardly from the upper surfaces 97 of the pair of side walls 30. The cutouts 96 are formed at approximately central portions in the front-rear direction 8 of the pair of side walls 30. A rear end of each of the cutouts 96 is comparted by a rear surface 96A. An upper end portion of the rear surface 96A is an inclined surface 96B. The inclined surface 96B is inclined upwardly toward the rear. A front end of the cutout 96 is comparted by a front surface 96C.

The projected parts 125 make contact with protrusions 124 (see FIG. 5) of the slide members 74 from front positions of the slide members 74 during a process in which the feed tray 20 is (being) inserted into the casing 14. Holes 126, which penetrate in the left-right direction 9, are formed at the upper end portions of the projected parts 125. Projections (bumps) 127 of the discharge tray 21 are inserted into the holes 126 (see FIG. 4).

The lever 75 (see FIG. 5; to be described later on) is arranged over or above the cutout 96. Therefore, each of the projected parts 125 is arranged while being offset to the inside in the left-right direction 9 of the side wall 30, and each of the projected parts 125 is made high. Accordingly, the position of the discharge tray 21 supported by the projected parts 125 is offset upwardly, and it is possible to make the height of the side guide 98, positioned under or below the discharge tray 21, to be high.

The upper surface 97 has a horizontal surface 97A which extends frontwardly from an upper end of the front surface 96C of the cutout 96.

<Discharge Tray 21>

As depicted in FIG. 4, the discharge tray 21 is rotatably supported by the feed tray 20, and the discharge tray 21 is movable in the front-rear direction 8 integrally with the feed tray 20. The discharge tray 21 is provided with the projections 127 which project or protrude in the left-right direction 9 from both of left and right ends disposed at rear end portions thereof. The projections 127 are inserted into the holes 126 which are formed through the projected parts 125 of the feed tray 20. Accordingly, the discharge tray 21 is rotatable (rockable, pivotable) in directions of arrows 131 with respect to the feed tray 20 about the center of the shaft or axis which passes through the centers of the projections 127 and which extends in the left-right direction 9. A front upper portion of the feed tray 20 is opened/closed in accordance with the rotation of the discharge tray 21. FIG. 4 depicts a state in which the feed tray 20 is closed by the discharge tray 21. The sheet 12 can be put in and taken out with respect to the feed tray 20 by rotating the discharge tray 21 upwardly from the closed state so that the feed tray 20 is opened.

As depicted in FIGS. 2 and 11, when the feed tray 20 is installed to the casing 14, an upper surface 31 of the discharge tray 21 constructs the bottom surface which comparts the internal space 23. The upper surface 31 supports the sheet 12 which is discharged to the internal space 23 after having an image recorded thereon by the recording part 24. The sheet 12, which is supported by the upper surface 31, is taken out by the user to the outside of the casing 14 via the opening 13.

As depicted in FIG. 4, the upper surface 31 has a front upper surface 31A, a rear upper surface 31B, and an inclined surface 31C. The front upper surface 31A extends rearwardly from a front end of the upper surface 31. The front upper surface 31A extends, in the front-rear direction 8, up to the vicinity of the front end of the horizontal surface 97A of the side wall 30 of the feed tray 20. The rear upper surface 31B extends frontwardly from a rear end of the upper surface 31. The rear upper surface 31B is positioned under or below the front upper surface 31A. The rear upper surface 31B is connected to the front upper surface 31A via the inclined surface 31C.

<Feeding Part 16>

As depicted in FIGS. 2 and 11, the feeding part 16 is positioned over or above the bottom wall 22 of the feed tray 20 in a state that the feed tray 20 is installed to the printer part 11 and is positioned under or below the recording part 24. The feeding part 16 is provided with a feed roller 25, a feed arm 26, and a driving transmitting mechanism 27. The feed roller 25 is rotatably supported at a forward end portion of the feed arm 26. The feed arm 26 is rotatable in the directions of arrows 29 about the center of a support shaft 28 provided at a proximal end portion of the feed arm 26. Accordingly, the feed roller 25 is capable of making contact with and separating away from the feed tray 20 or the sheet 12 supported by the feed tray 20.

The feed roller 25 is rotated by a driving force of a conveying motor 73 (see FIG. 3) transmitted by the driving transmitting mechanism 27 including a plurality of gears. Accordingly, a sheet 12, which is disposed on the uppermost side, among sheets 12 supported by the bottom wall 22 of the feed tray 20, and which makes contact with the feed roller 25, is fed to the conveying passage 65. Note that the feed roller 25 may be rotated by the driving force applied thereto from a motor which is provided separately from the conveying motor 73. Further, the driving transmitting mechanism 27 is not limited to the form which includes the plurality of gears. For example, the driving transmitting mechanism 27 may be of an aspect which includes a belt which is stretched between the support shaft 28 and the shaft of the feed roller 25.

<Conveying Passage 65>

As depicted in FIG. 2, the conveying passage 65 extends from a rear end portion of the feed tray 20. The conveying passage 65 is formed at a location behind or on the rear side of the internal space 23. In other words, the conveying passage 65 is formed at a position opposite to the opening 13 positioned at the front end of the casing 14, with respect to the internal space 23. The conveying passage 65 is provided with a curved part 33 (example of a "first path") and a straight part 34 (example of a "second path"). The curved part 33 is curved such that the rear side thereof becomes to be the outer side of the curvature and the front side thereof becomes to be the inner side of the curvature. The straight part 34 extends in the front-rear direction 8.

The curved part 33 extends upwardly from the rear end portion of the feed tray 20, while the curved part 33 U-turns from the rear side to the front side. The curved part 33 is formed by a first guide member 18 and a second guide member 19 which are opposed to one another while being separated from each other by a predetermined spacing distance. The first guide member 18 comparts the outer side of the curvature of the curved part 33. The second guide member 19 comparts the inner side of the curvature of the curved part 33.

The straight part 34 extends generally in the front-rear direction 8. A rear end of the straight part 34 is continued to the curved part 33. A front end of the straight part 34 is continued to the internal space 23. In other words, the straight part 34 is continued to the curved part 33, and the straight part 34 extends frontwardly to arrive at the internal space 23. In other words, the straight part 34 extends rearwardly from the internal space 23. The straight part 34 is formed by the recording part 24 and the platen 42 which are opposed to one another while being separated from each other by a predetermined spacing distance, at a position, in the casing 14, at which the recording part 24 is arranged. The first guide member 18 and the second guide member 19 are provided to extend in the left-right direction 9 which is a direction orthogonal to the sheet surface of FIG. 2.

The sheet 12, which is supported by the feed tray 20, is conveyed so that the sheet 12 U-turns from the downward to the upward through the curved part 33 by means of the feed roller 25, and the sheet 12 arrives at the conveying roller pair 59. The sheet 12, which is nipped by the conveying roller pair 59, is conveyed frontwardly through the straight part 34, with the image recording surface being directed to the recording part 24. The image recording surface of the sheet 12, which arrives at the position just under or immediately below the recording part 24, is subjected to the recording of the image by the recording part 24. The sheet 12, on which the image has been recorded, is conveyed frontwardly through the straight part 34, and the sheet 12 is discharged to the upper surface 31 of the discharge tray 21. As described above, the sheet 12 is conveyed along with a conveying orientation 15 indicated by an arrow of alternate long and short dash line depicted in FIG. 2.

<Base Member 90>

The base member 90 depicted in FIG. 3 is a member which constructs a lower portion of the printer part 11. The base member 90 is integrally formed or molded with a resin material such as PBT, ABS, etc.

As depicted in FIG. 3, the base member 90 is provided with a right part 91 which constitutes the right side of the printer part 11, a left part 92 which constitutes the left side of the printer part 11, and a connecting part 93 which connects the right part 91 and the left part 92.

The bottom surface of the base member 90 is a placing surface when the multifunction machine 10 is placed, for example, on a desk.

The right part 91 is positioned rightwardly as compared with the feed tray 20 installed to the casing 14. The left part 92 is positioned leftwardly as compared with the feed tray 20 installed to the casing 14. In other words, the feed tray 20 is installed between the right part 91 and the left part 92.

Figure 12:
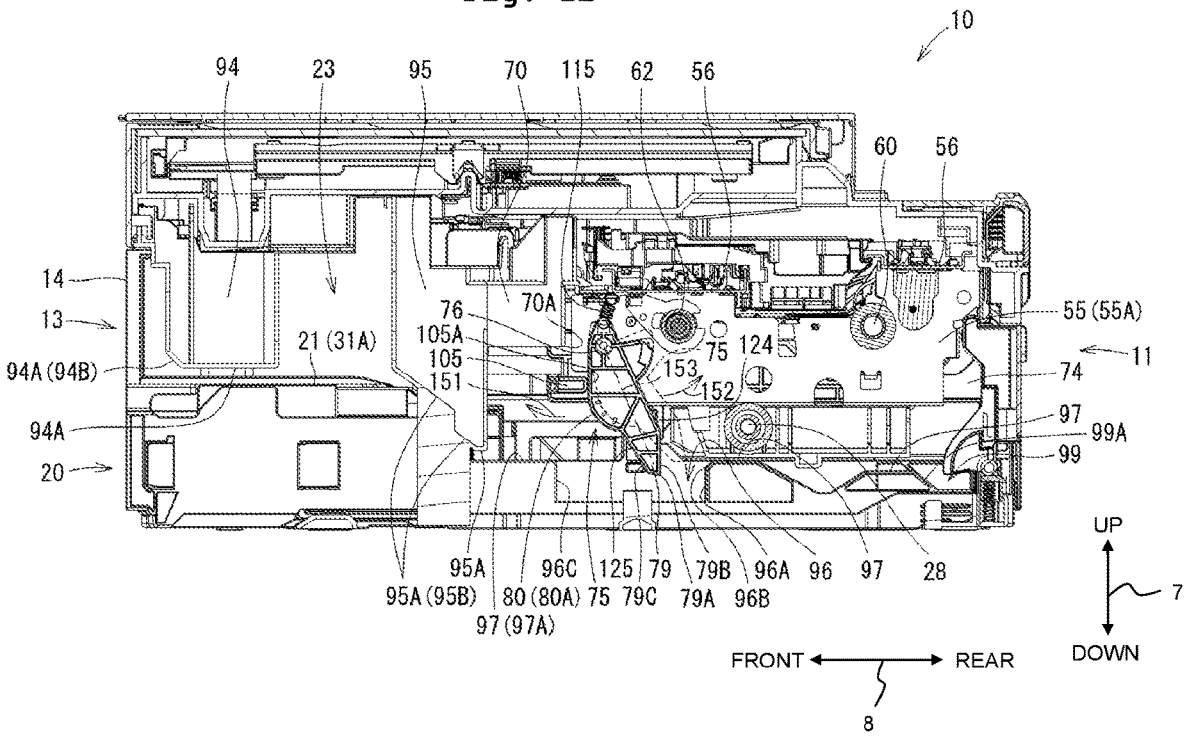
FIG. 12 is a vertical cross-sectional view depicting the printer part at a position at which the lever on the right side can be seen from a right position in the state that the feed tray is installed.

As depicted in FIGS. 3 and 12, each of the right part 91 and the left part 92 is provided with a first protrusion 94 and a second protrusion 95. The first protrusion 94 and the second protrusion 95, which are provided for the right part 91, protrude leftwardly from the left surface of the right part 91. The first protrusion 94 and the second protrusion 95, which are provided for the left part 92, protrude rightwardly from the right surface of the left part 92. The second protrusion 95 is positioned at the rear side of the first protrusion 94. The first protrusion 94 and the second protrusion 95 are provided while providing a spacing distance in the front-rear direction 8.

A lower surface 94A of the first protrusion 94 and a lower surface 95A of the second protrusion 95 are capable of making contact with the upper surface 97 of the side wall of the feed tray 20 and the upper surface 31 of the discharge tray 21 from thereabove (from the upper positon). The lower surface 94A has an inclined surface 94B. The inclined surface 94B is inclined downwardly toward the rear. The lower surface 95A has an inclined surface 95B. The inclined surface 95B is inclined downwardly toward the rear. The inclined surfaces 94B, 95B downwardly guide the feed tray 20 inserted into the casing 14.

As depicted in FIG. 12, each of the right part 91 and the left part 92 is provided with a third protrusion 70 which is disposed at the rear side of the second protrusion 95. The third protrusion 70 is continued to the second protrusion 95. A lower end of the third protrusion 70 is positioned upwardly as compared with the lower end of the second protrusion 95. A rear lower end part 70A of the third protrusion 70 makes contact with the lever 75 so as to regulate the rotation of the lever 75 in the orientation of an arrow 151.

As depicted in FIG. 11, the connecting part 93 has a recess 118 which is disposed under or below the platen 42 and which is recessed downwardly. The bottom of the recess 118 is comparted by a surface 119. The surface 119 is sandwiched, in the front-rear direction 8, by walls 120, 121 which protrude upwardly from the surface 119. The wall 120 is positioned in front of the wall 121. The walls 120, 121 extend in the left-right direction 9. The wall 120 has an inclined surface 122 on its upper surface. The inclined surface 122 is inclined upwardly toward the rear.

<Side Frame 55>

As depicted in FIG. 5, a pair of side frames 55 are provided with a spacing distance therebetween in the left-right direction 9. Each of the side frames 55 is integrally formed with a metal material. Each of the side frames 55 is provided with a side plate 55A which expands in the up-down direction 7 and the front-rear direction 8 and a bottom plate 55B which extends inwardly in the left-right direction 9 from a lower end of the side plate 55A (leftwardly in the case of the side frame 55 on the right side and rightwardly in the case of the side frame 55 on the left side). The bottom plate 55B supports the slide member 74.

Each of the side frames 55 is provided with a projection 36 and a projection 37. The projection 36 and the projection 37 extend outwardly in the left-right direction 9 from an upper end of the side plate 55A (rightwardly in the case of the side frame 55 on the right side and leftwardly in the case of the side frame 55 on the left side). The projection 36 is positioned in front of the projection 37.

Figure 10A:
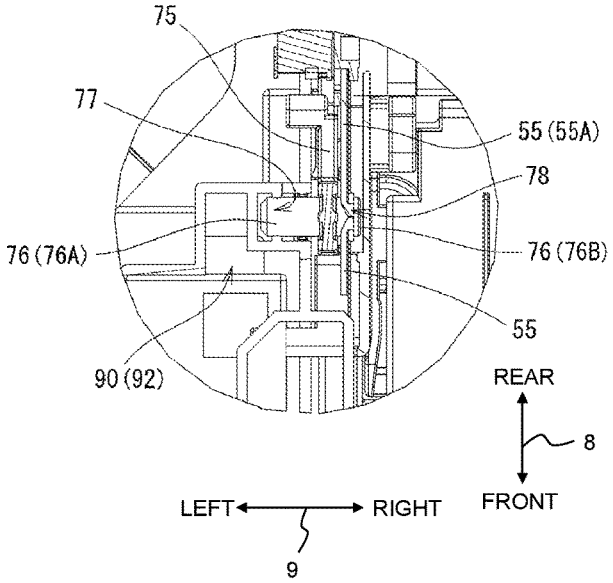
FIG. 10A depicts a lever and those in the vicinity thereof as viewed from an upper position in order to depict the connection between a shaft of the lever and the base member and the side frame.
Figure 10B:
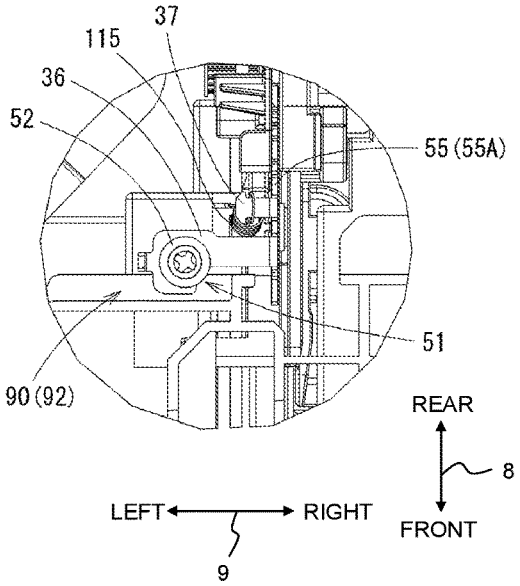
FIG. 10B depicts the side frame as viewed from an upper position in order to depict the fixation between the side frame and the base member.

The projection 36 has a cutout 51. As depicted in FIG. 10B, the base member 90 is positioned under or below the projection 36, and a screw hole (not depicted), which is formed in the base member 90, is positioned under or below the cutout 51. A screw 52 penetrates through the cutout 51 from thereabove, and the screw 52 is fastened to the screw hole. Accordingly, the side frame 55 is secured to the base member 90.

<Recording Part 24>

As depicted in FIG. 2, the recording part 24 is provided over or above the straight part 34. The recording part 24 is provided with a carriage 40 and a recording head 38 (example of a "head"). The platen 42 is provided at a position which is disposed under or below the recording part 24 and which is opposed to the recording part 24. The platen 42 is a member which supports the sheet 12 conveyed through the straight part 34. The platen 42 will be explained in detail later on.

The carriage 40 is supported by two guide rails 56 which are arranged, with a spacing distance therebetween in the front-rear direction 8, so that the carriage 40 is reciprocatively movable in the left-right direction 9. Each of the two guide rails 56 is integrally formed with a metal material. The two guide rails 56 are supported by the side plates 55A of the pair of side frames 55 (see FIG. 3).

The recording head 38 is mounted on the carriage 40. Inks are supplied from ink cartridges 100 (see FIG. 1) to the recording head 38. A plurality of nozzles 39 are formed in the lower surface of the recording head 38. The plurality of nozzles 39, which are formed in the lower surface of the recording head 38, construct a plurality of nozzle arrays which are arranged side by side with a spacing distance therebetween in the left-right direction 9. Each of the plurality of nozzle arrays is constructed by a predetermined number of (a plurality of) the nozzles 39 which are aligned, with spacing distances therebetween, in the conveying orientation 15 (front-rear direction 8). In other words, the number of the nozzles 39 formed in the lower surface of the recording head 38 is a number obtained by multiplying the number of the nozzle arrays by the predetermined number. Note that FIG. 2 schematically depicts one nozzle array.

When the carriage 40 is moving in the left-right direction 9, the recording head 38 discharges ink droplets from the nozzles 39 toward the platen 42. Accordingly, the image is recorded on the sheet 12 which is in the state of being supported by the platen 42.

The carriage 40 is movable to an opposing area 154 and retracted areas 155, 156 as depicted in FIG. 5.

The opposing area 154 is an area in which the carriage 40 is moved when the recording head 38 records the image on the sheet 12. The opposing area 154 is an area which is opposed to the platen 42 in the up-down direction 7. In other words, the opposing area 154 is positioned over or above the platen 42 and the straight part 34 of the conveying passage 65. The opposing area 154 is the area which is disposed between the two slide members 74.

The retracted areas 155, 156 are areas which are disposed outside the slide members 74 in the left-right direction 9. The retracted area 155 is the area which is disposed rightwardly as compared with the slide member 74 on the right side), and the retracted area 156 is the area which is disposed leftwardly as compared with the slide member 74 on the left side).

A maintenance mechanism is arranged in the retracted area 155. The maintenance mechanism is provided with, for example, a cap which is movable upwardly/downwardly and which covers the nozzles 39 of the recording head 38, and a waste liquid storage part which is connected to the cap via a tube, etc. The maintenance for the recording head 38 includes, for example, a blank discharge of the ink. When the maintenance is executed, the carriage 40 is moved to the retracted area 155. The cap is moved upwardly to cover the nozzles 39. The inks are discharged from the nozzles 39. The discharged inks flow to the waste liquid storage part via the tube. Note that the maintenance mechanism may be arranged in the retracted area 156.

<Conveying Roller Pair 59 and Discharge Roller Pair 44>

As depicted in FIG. 2, the conveying roller pair 59 is arranged upstream in the conveying orientation from a support surface of the platen 42 and the recording head 38 in the straight part 34 of the conveying passage 65 (rearwardly from the recording head 38).

The conveying roller pair 59 is provided with a conveying roller 60 (example of a "driving roller") which is arranged under or below the straight part 34 and a pinch roller 61 (example of a "driven roller") which is arranged over or above the straight part 34 while being opposed to the conveying roller 60 and which follows the conveying roller 60.

As depicted in FIG. 5, the conveying roller 60 is a columnar member which extends in the left-right direction 9. The conveying roller 60 is rotatably supported by the side plates 55A of the pair of side frames 55 by the aid of bearings 71. In this embodiment, each of the bearings 71 is fitted to a cutout which is formed on the side plate 55A, and the conveying roller 60 is inserted into the bearings 71.

The pinch roller 61 depicted in FIG. 2 is rotatably supported by roller holders 85 depicted in FIGS. 5 and 11. As depicted in FIG. 5, coil springs 57 (example of a "biasing member) are provided over or above the roller holders 85. Lower ends of the coil springs 57 are connected to the roller holders 85, and upper ends of the coil springs 57 are connected to a lower surface of the guide rail 56 depicted in FIG. 3. Accordingly, the roller holders 85 are supported by the guide rail 56 by the aid of the coil springs 57. The roller holders 85 are biased downwardly by the coil springs 57. Accordingly, the pinch roller 61, which is supported by the roller holders 85, is biased by the conveying roller 60. Each of the roller holders 85 is provided with a projected part 88 which is provided at a rear portion thereof and which extends upwardly. A forward end of the projected part 88 is placed or put on the guide rail 56 and the forward end is supported thereby (see FIGS. 3 and 11). Accordingly, the attitude of each of the roller holders 85 is stabilized. Each of the roller holders 85 has a through-hole 86 which penetrates through the roller holder 85 in the left-right direction 9. A shaft 87 is inserted into the through-holes 86. The roller holders 85 and the shaft 87 are an example of a "roller supporting part".

The conveying roller pair 59 can be changed to (between) the nipping state and the separated state. When any external force is not applied to the shaft 87, the pinch roller 61 makes contact with the conveying roller 60 by being biased by the coil spring 57. In this situation, the conveying roller pair 59 is in the nipping state. When the shaft 87 is moved upwardly by being guided by the projection 106 of the slide member 74, the pinch roller 61 is separated from the conveying roller 60 against the biasing force of the coil spring 57 (see FIG. 19). In this situation, the conveying roller pair 59 is in the separated state. The roller holder 85, the shaft 87 and the slide member 74 are an example of a "moving mechanism".

As depicted in FIG. 2, the discharge roller pair 44 is arranged downstream in the conveying orientation from the support surface of the platen 42 and the recording head 38 in the straight part 34 (in front of the recording head 38).

The discharge roller pair 44 is provided with a discharge roller 62 (example of a "roller") which is arranged under or below the straight part 34 and a spur 63 (example of the "roller") which is arranged opposingly to the discharge roller 62 at a location over or above the straight part 34 and which follows the discharge roller 62.

As depicted in FIG. 5, the discharge roller 62 is provided with a shaft 64 which extends in the left-right direction 9 and a roller part 58 which covers the outer circumference of the shaft 64. A plurality of pieces of the roller part 58 are provided with spacing distances therebetween in the left-right direction 9. The shaft 64 of the discharge roller 62 is rotatably supported by the side plates 55A of the pair of side frames 55 by the aid of bearings 72. In this embodiment, the bearing 72 is fitted to a cutout formed on each of the side plates 55A, and the shaft 64 is inserted into the bearing 72.

The spur 63 depicted in FIG. 2 is provided as a plurality of spurs 63, with spacing distances therebetween in the left-right direction 9. The respective spurs 63 are provided at positions opposed to the roller parts 58, respectively, in the left-right direction 9. Each of the spurs 63 is biased against one of the roller parts 58 by an unillustrated elastic member (for example, a coil spring).

The conveying roller 60 and the discharge roller 62 are rotated by the driving force transmitted from a conveying motor 73 (see FIG. 5). When the conveying roller 60 is rotated in a state (nipping state) in which the sheet 12 is nipped by the conveying roller pair 59, the sheet 12 is conveyed in the conveying orientation 15 by the conveying roller pair 59. Further, when the discharge roller 62 is rotated in the state in which the sheet 12 is nipped by the discharge roller pair 44, the sheet 12 is conveyed in the conveying orientation 15 by the discharge roller pair 44.

<Contact Member 41>

As depicted in FIG. 2, the contact member 41 is positioned upstream in the conveying orientation 15 from the nozzles 39 of the recording part 24 in the conveying passage 65.

As depicted in FIG. 5, the contact member 41 is provided with a plurality of extending parts 81 and one main body part 82. The main body part 82 extends in the left-right direction 9. The main body part 82 is attached to the guide rail 56 (see FIG. 3) by being fitted thereto from therebelow (from the lower position). The plurality of extending parts 81 extend frontwardly and downwardly from the main body part 82, with spacing distances therebetween in the left-right direction 9.

In this embodiment, the contact member 41 is an integrally formed or molded product containing, as a main component thereof, a resin such as polyacetal (POM), etc. Note that it is also allowable that the contact member 41 is not the integrally formed product. For example, the contact member 41 may be composed of a plurality of extending parts 81 without including the main body part 82, and the respective extending parts 81 may be attached to the guide rail 56.

As depicted in FIG. 2, each of the extending parts 81 extends up to the vicinity of the nozzles 39 in the conveying orientation 15. A forward end of each of the extending parts 81 is positioned under or below the nipping position at which the sheet 12 is nipped by the conveying roller pair 59 (position at which the conveying roller 60 and the pinch roller 61 are brought in contact).

<Platen 42>

As depicted in FIG. 2, the platen 42 is positioned at a position which is disposed under or below the recording part 24 and which is opposed to the recording part 24. The platen 42 is a member which supports the sheet 12 conveyed through the straight part 34 by the conveying roller pair 59.

Figure 6:
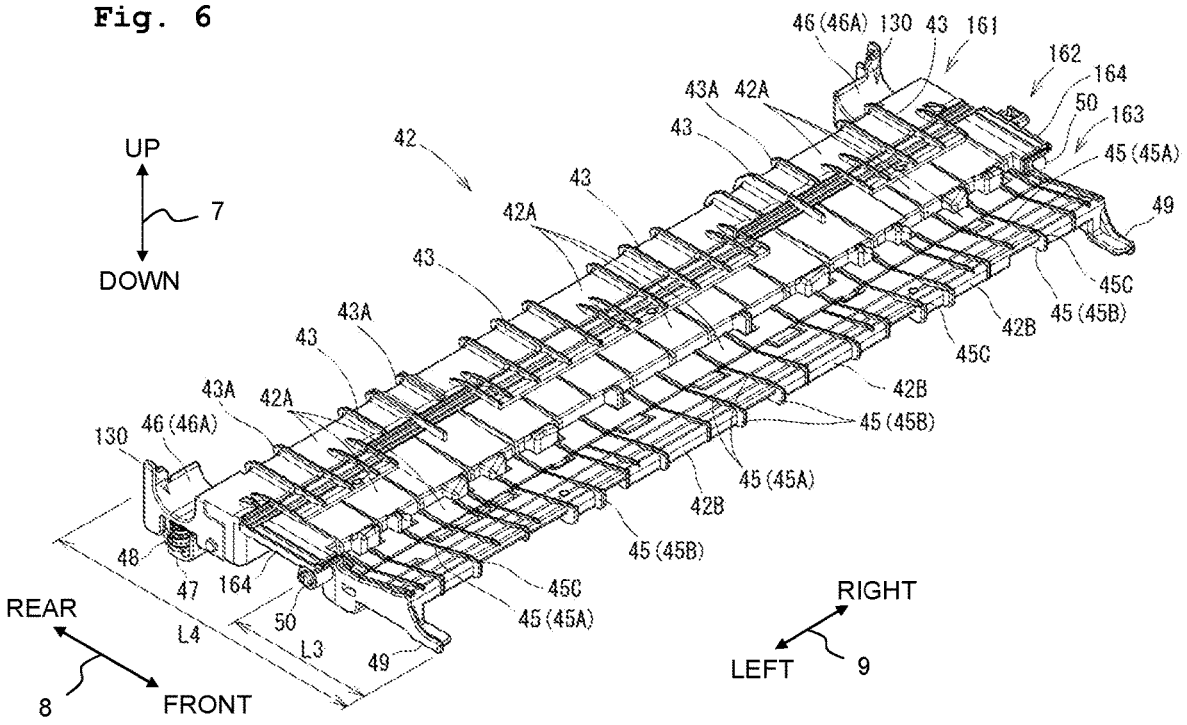
FIG. 6 is a perspective view depicting a platen as viewed from an upper position.

As depicted in FIG. 6, the platen 42 is a generally plate-shaped member. The platen 42 is composed of a rear part 161, a central part 162, and a front part 163. The rear part 161 constitutes a rear portion of the platen 42. The central part 162 is continued to a front end of the rear part 161, and the central part 162 constitutes a central portion in the front-rear direction 8 of the platen 42. The front part 163 is continued to a front end of the central part 162, and the front part 163 constitutes a front portion of the platen 42.

The central part 162 is positioned between most upstream nozzles 39A in the conveying orientation 15 (see FIG. 2) and most downstream nozzles 39B in the conveying orientation 15 (see FIG. 2) which are included in the nozzles 39 constructing the nozzle arrays.

The rear part 161 is positioned at the rear side of (upstream in the conveying orientation 15 from) the central part 162. At least a part of the rear part 161 is positioned in front of (downstream in the conveying orientation 15 from) the nozzles 39A. The front part 163 is positioned in front of the central part 162. At least a part of the front part 163 is positioned at the rear side of the nozzles 39B.

A plurality of ribs 43 and a plurality of ribs 45 are formed on the upper surface 42A of the platen 42.

The plurality of ribs 43 are formed to range from the rear part 161 to the rear portion of the central part 162. The respective ribs 43 extend in the conveying orientation 15 (front-rear direction 8). The respective ribs 43 are provided, with spacing distances therebetween in the left-right direction 9.

Figure 7:
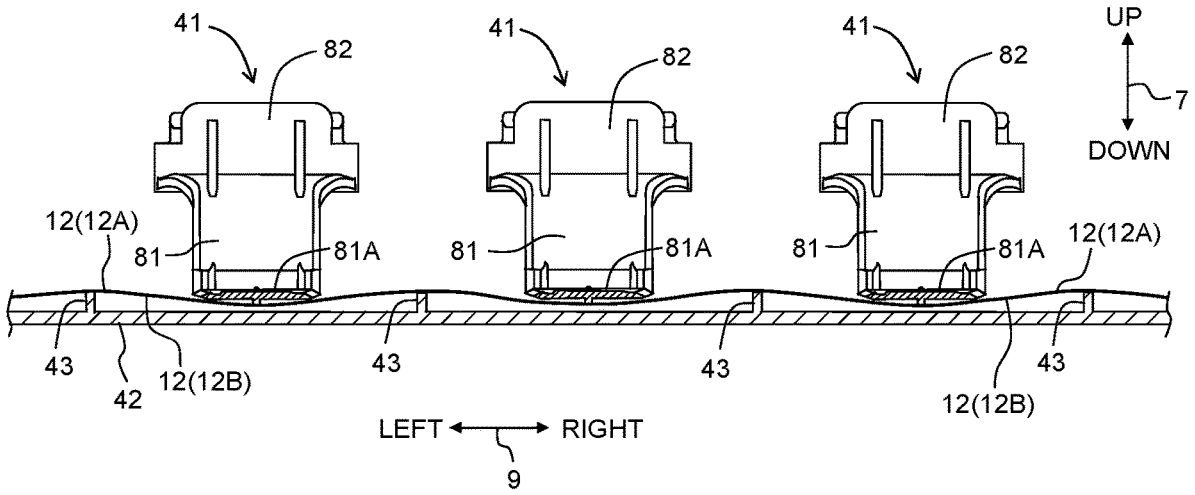
FIG. 7 is a schematic cross-sectional view depicting a contact member, the platen, and recording paper.

As depicted in FIG. 7, the upper end of each of the ribs 43 is positioned over or above a forward end part 81A of each of the extending parts 81 of the contact member 41. The forward end part 81A makes contact with an upper surface 12A of the conveyed sheet 12 between the conveying roller pair 59 and the nozzles 39 in the straight part 34. Further, the upper surface of each of the ribs 43 makes contact with a lower surface 12B of the conveyed sheet 12 between the conveying roller pair 59 and the nozzles 39 in the straight part 34. The sheet 12 has a wavy or wave-like shape continued in the left-right direction 9 by making contact with the forward end parts 81A of the extending parts 81 from thereabove and making contact with the ribs 43 from therebelow.

As depicted in FIG. 6, the plurality of ribs 45 are formed at the front part 163. The respective ribs 45 are provided, with spacing distances therebetween in the left-right direction 9. Each of the ribs 45 is composed of an upper part 45A and a side part 45B. The upper part 45A extends in the conveying orientation 15 (frontward orientation) on the upper surface 42A of the front part 163 up to a front end of the upper surface 42A of the front part 163. The side part 45B is continued to a downstream end (front end of the upper part 45A) in the conveying orientation 15 of the upper part 45A. The side part 45B extends downwardly in the up-down direction 7 on the front side surface 42B of the front part 163. An upper surface of the rib 45 (in particular, an upper surface of the upper part 45A of the rib 45) makes contact with the lower surface 12B of the conveyed sheet 12. The upper surfaces of the ribs 43, 45 form or correspond to a "support surface", in the platen 42, which supports the sheet 12 on the platen 42. In other words, in this embodiment, there is a plurality of pieces of the support surface which supports the sheet 12. A rear end part 43A of the upper surface of the rib 43 corresponds to an end portion in the first orientation of the support surface. A front end part 45C of the upper surface of the rib 45 corresponds to an end portion in the second orientation of the support surface.

As depicted in FIG. 11, when the platen 42 is located at the printing position (to be described later on), a lower end of the side part 45B is positioned over or above a lower end of the shaft 64 of the discharge roller 62.

As depicted in FIG. 6, the platen 42 has projected parts 49 (example of a "contact part") which protrude frontwardly from both of left and right end portions of the front side surface 42B.

The platen 42 has projected parts 46 which project or protrude rearwardly from both of left and right end portions of the rear part 161. Upper surfaces 46A of the projected parts 46 are each recessed downwardly while being curved in a circular arc-shaped form. In other words, recesses 130 are formed by the upper surfaces 46A.

The recesses 130, which are formed by the upper surfaces 46A of the projected parts 46, are arranged side by side in the left-right direction 9 with the cutouts of the side plates 55A of the side frames 55 to which the bearings 71 (see FIG. 3) are fitted. Specifically, a projected part 46, which is included in the projected parts 46 and which protrudes from the right end portion of the platen 42, is arranged side by side to the left position of the side plate 55A of the side frame 55 on the right side, and a projected part 46, which is included in the projected parts 46 and which protrudes from the left end portion of the platen 42, is arranged side by side to the right position of the side plate 55A of the side frame 55 on the left side. In other words, the projected parts 46 are positioned on the inner sides of the side plates 55A of the pair of side frames 55 in the left-right direction 9. As for the bearing 71, the outer portion thereof in the left-right direction 9 is fitted to the cutout of the side plate 55A of the side frame 55, and the inner portion thereof in the left-right direction 9 is fitted to the recess formed by the upper surface 46A of the projected part 46. In other words, the upper surface 46A makes contact with the bearing 71 along with the circumferential direction of the shaft of the conveying roller 60. Note that the upper surface 46A may make contact with the shaft of the conveying roller 60 and the side plate 55A of the side frame 55 along with the circumferential direction of the shaft of the conveying roller 60, rather than making contact with the bearing 71.

Accordingly, the platen 42 is rotatable about the bearings 71. In other words, the platen 42 is rotatable about the shaft or axis of the conveying roller 60. The platen 42 is rotatable between a printing position depicted in FIGS. 11 and 13 and a release position depicted in FIGS. 20 and 22.

The printing position is a position of the platen 42 when the recording part 24 records the image on the sheet 12. As depicted in FIG. 2, when the platen 42 is located at the printing position, then the upper surface 42A of the platen 42 generally expands in the front-rear direction 8 and the left-right direction 9, and the upper surface 42A of the platen 42 is opposed to the recording head 38.

Figure 20:
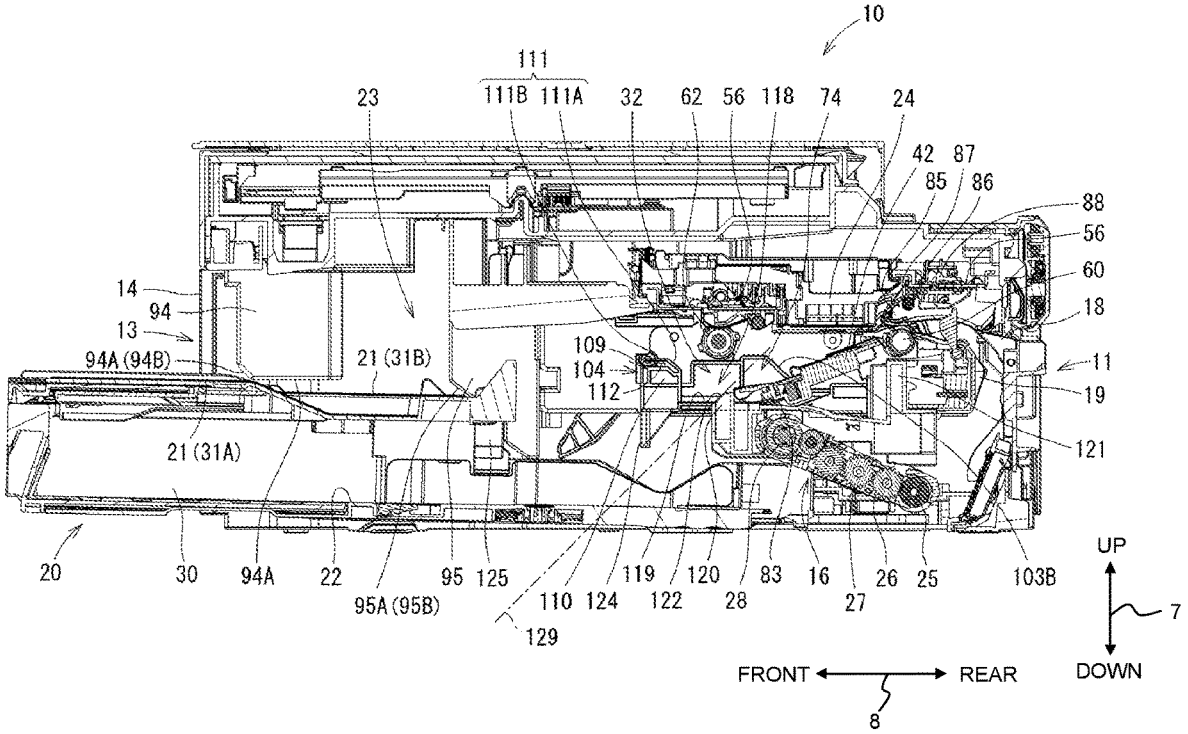
FIG. 20 is a vertical cross-sectional view taken along the center in the left-right direction of the printer part in a case that the slide member is located at a front position.
Figure 22:
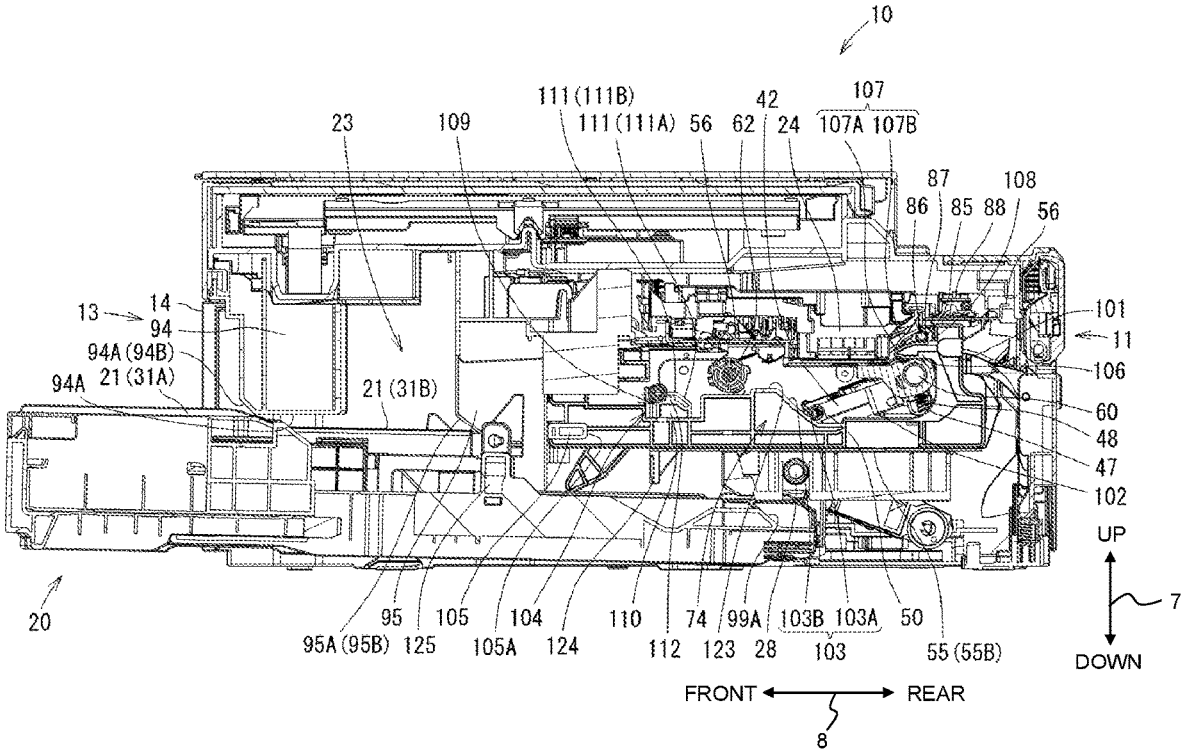
FIG. 22 is a vertical cross-sectional view depicting the printer part at a position at which the right side surface of the platen is viewed when the slide member is located at the front position.

The release position is a position of the platen 42 to be provided when the sheet 12, which is jammed in the space between the recording part 24 and the platen 42, is taken out to the outside of the casing 14. As depicted in FIGS. 20 and 22, when the platen 42 is located at the release position, a front end portion of the platen 42 is positioned downwardly as compared with when the platen 42 is located at the printing position. In this situation, the support surface of the platen 42 for supporting the sheet 12 is positioned downwardly as compared with when the platen 42 is located at the printing position. Accordingly, as depicted in FIG. 20, a gap 32 is generated between the front end portion of the platen 42 and the discharge roller pair 44. Accordingly, the space between the recording part 24 and the platen 42, which is included in the straight part 34, is communicated with the internal space 23 via the gap 32.

As depicted in FIG. 6, a contact piece 47 is provided at a location under or below the projected part 46. The contact piece 47 is attached to the projected part 46 with a coil spring 48 intervening therebetween. One end of the coil spring 48 is connected to a lower surface of the projected part 46, and the other end of the coil spring 48 is connected to the contact piece 47.

Figure 13:
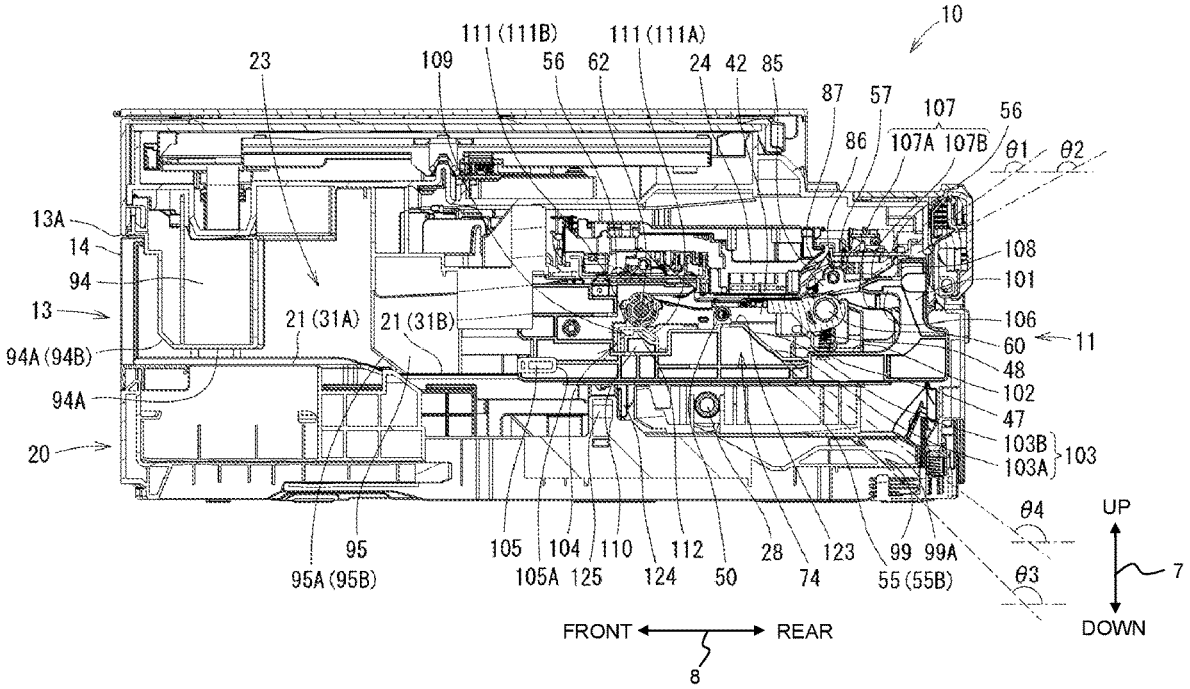
FIG. 13 is a vertical cross-sectional view depicting the printer part at a position at which a right side surface of the platen can be seen in the state that the feed tray is installed.

As depicted in FIG. 13, the contact piece 47 is supported by making contact with a support surface 102 of the slide member 74 from therebelow. Further, as depicted in FIG. 11, the projected part 49 is supported by a protrusion 104 of the slide member 74 from therebelow. Accordingly, the platen 42, which is located at the printing position, is supported by the slide member 74.

Figure 19:
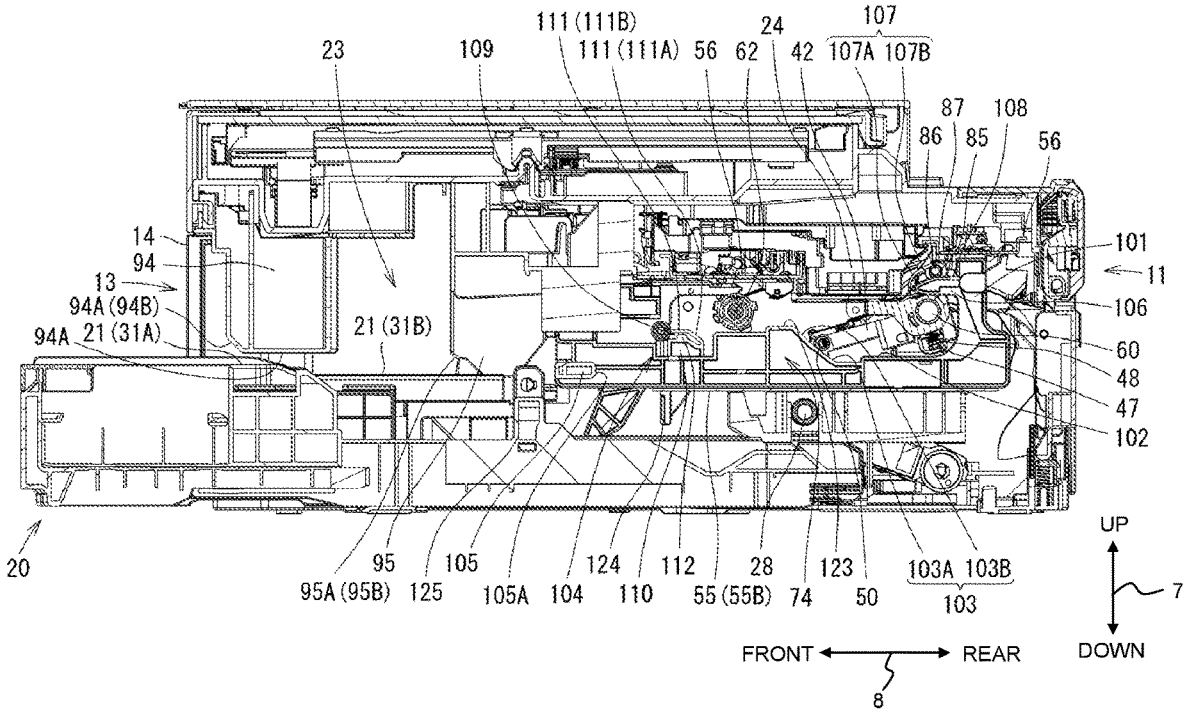
FIG. 19 is a vertical cross-sectional view depicting the printer part at a position at which the right side surface of the platen can be seen in the state that the conveying roller pair is changed to be in the separated state.

As depicted in FIG. 6, the platen 42 has projections 50 which project or protrude in the left-right direction 9 from a right side surface and a left side surface of the central part 162. As depicted in FIG. 19, the projections 50 are guided by making contact with inclined surfaces 103 (example of a "second guide part") of the slide members 74, and thus the platen 42 is rotated.

As depicted in FIG. 6, the projections 50 are provided on the central part 162 not on the rear part 161 and the front part 163. In other words, the projections 50 are provided at the central portion of the platen 42 in the front-rear direction 8. In this embodiment, a length L3, which ranges in the front-rear direction 8 from the front end of the platen 42 to the projection 50, is not less than ¼ of a length L4 which ranges in the front-rear direction 8 from the front end to the rear end of the platen 42.

The central part 162 of the platen 42 has protrusions 164 which protrude in the left-right direction 9 from the upper end portions of the right side surface and the left side surface. Upper surfaces of the protrusions 164 constitute parts of the upper surface 42A of the platen 42. The projections 50 are positioned under or below the protrusions 164. In other words, the protrusions 164 cover upper portions of the projections 50. In other words, the upper surfaces 42A of the protrusions 164 of the platen 42 are positioned over or above the projections 50, and the upper surfaces 42A cover the upper portions of the projections 50.

The dimension or size in the left-right direction 9 of the central part 162 is longer by the dimensions or sizes of the protrusions 164 than the dimension or size in the left-right direction 9 of the front part 163.

Figure 8:
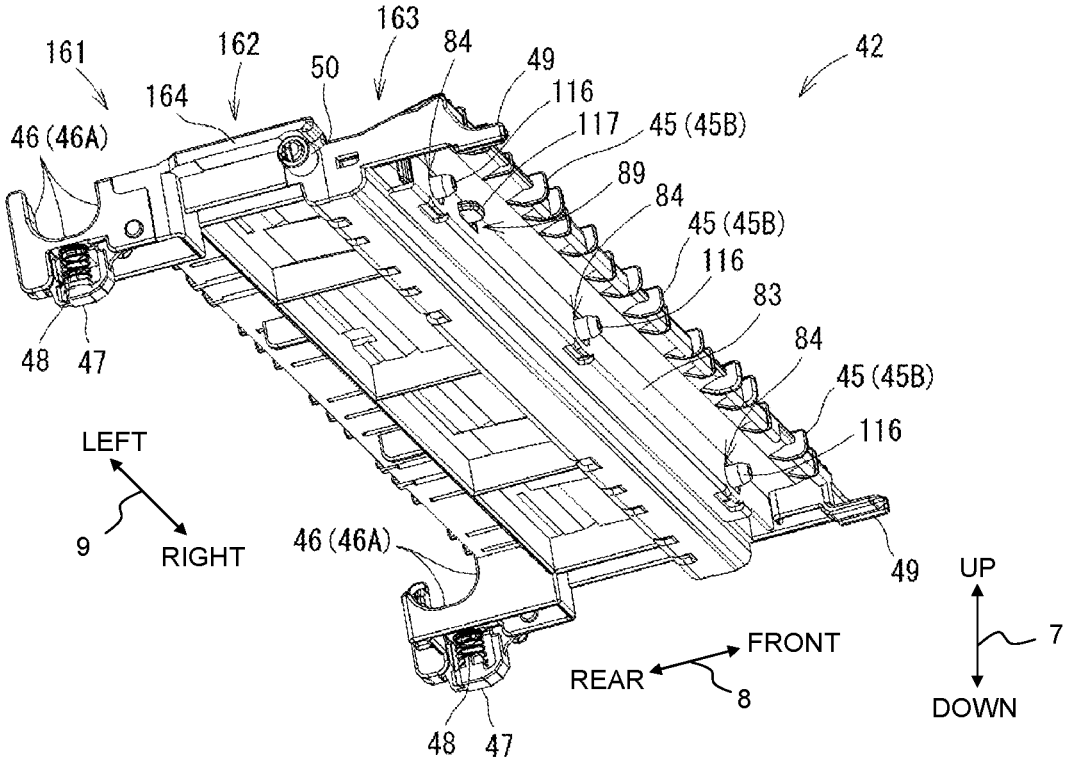
FIG. 8 is a perspective view depicting the platen as viewed from a lower position.

As depicted in FIG. 8, the platen 42 is provided with a plate member 83 which is composed of a metal such as iron, etc. In this embodiment, the plate member 83 is bent, and the plate member 83 has holes 84, 89. The platen 42 has, on the lower surface, projections 116 and a projection 117 which project or protrude frontwardly. The projections 116 are inserted into the holes 84, and the projection 117 is inserted into the hole 89. Thus, the plate member 83 is attached to the platen 42. The plate member 83 is positioned on the front side as compared with the center in the front-rear direction 8 of the platen 42. In other words, the plate member 83 is attached to a position nearer to a downstream end in the conveying orientation 15 of the platen 42 as compared with an upstream end in the conveying orientation 15 of the platen 42.

As depicted in FIG. 20, when the platen 42 is located at the release position, a part of the front end portion of the platen 42 enters the recess 118 of the base member 90. In this situation, the platen 42 is supported by the surface 119 of the base member 90. In this embodiment, the plate member 83, which is attached to the platen 42, makes contact with the surface 119 from thereabove. Thus, the plate member 83 is supported by the surface 119. Accordingly, the platen 42 is supported by the base member 90.

Note that in this embodiment, the plate member 83 is supported by the surface 119 over the range ranging from the left end to the right end thereof, i.e., over the entire range in the left-right direction 9 thereof. However, it is sufficient, regarding the plate member 83, that at least a central portion in the left-right direction 9 of the plate member 83 is supported by the surface 119. Further, it is also allowable that any portion of the platen 42 other than the plate member 83 is supported by the surface 119.

As depicted in FIG. 20, when the platen 42 is located at the release position, a virtual plane 129, which includes the inclined surface 122 of the wall 120, is positioned over or above the platen 42. In other words, when the platen 42 is located at the release position, the virtual plane 129, which includes the inclined surface 122 of the wall 120, covers the platen 42 from the upper position.

The platen 42 is positioned under or below the upper end 13A of the opening 13 (see FIG. 11) and the platen 42 is positioned over or above the lower end 13B of the opening 13 (see FIG. 11), regardless of the position of the platen 42.

<Interlocking Mechanism>

The interlocking mechanism is such a mechanism which causes the platen 42 to rotate from the printing position to the release position while being interlocked with withdrawal or removal (pulling out) of the feed tray 20 from the casing 14 (movement of the feed tray 20 toward the front), and which causes the platen 42 to rotate from the release position to the printing position while being interlocked with the insertion of the feed tray 20 into the casing 14 (movement of the feed tray 20 toward the rear side). As depicted in FIGS. 5, 12, and 13, the interlocking mechanism is provided with the slide members 74, the levers 75, and the coil springs 115.

<Slide Member 74>

As depicted in FIG. 5, the slide members 74 are supported slidably in the front-rear direction 8 by the bottom plates 55B of the pair of side frames 55. In other words, two pieces of the slide member 74 are provided, which are positioned inside the side plates 55A in the left-right direction 9. That is, the slide members 74 are provided on the left side of the side frame 55 on the right side and on the right side of the side frame 55 on the left side. The slide members 74 are adjacent to the side plates 55A of the pair of side frames 55.

Each of the slide members 74 slides between a rear position depicted in FIG. 13 (example of a "first position") and a front position depicted in FIG. 22 (example of a "second position").

As described later on, each of the slide members 74 slide from the rear position to the front position while being interlocked with the withdrawal of the feed tray 20 from the casing 14, and the slide members 74 slide from the front position to the rear position while being interlocked with the insertion of the feed tray 20 into the casing 14. Further, the platen 42 is rotated from the printing position to the release position while being interlocked with the slide (sliding movement) of the slide members 74 from the rear position to the front position, and the platen 42 is rotated from the release position to the printing position while being interlocked with the slide (sliding movement) of the slide members 74 from the front position to the rear position.

As depicted in FIGS. 5 and 13, each of the slide members 74 is provided with a protrusion 101, the support surface 102, the inclined surface 103, a horizontal surface 123, the protrusion 104, a protrusion 105, and the protrusion 124.

As depicted in FIG. 13, the protrusion 101 protrudes upwardly from a rear end portion of the slide member 74. The projection 106, which protrudes frontwardly, is provided at an upper end portion of the protrusion 101. An upper surface of the projection 106 is composed of an inclined surface 107 (example of a "first guide part") and a horizontal surface 108. The inclined surface 107 is positioned on the side of a forward end of the projection 106, and the inclined surface 107 is inclined downwardly toward the front (forward end of the projection 106). The horizontal surface 108 is positioned on the side of a proximal end of the projection 106, and the horizontal surface 108 is continued to a rear end of the inclined surface 107. The horizontal surface 108 is a surface which expands in the front-rear direction 8 and the left-right direction 9.

The inclined surface 107 is provided with a forward end side inclined surface 107A (example of a "first inclined surface) and a proximal end side inclined surface 107B (example of a "second inclined surface). The forward end side inclined surface 107A is positioned frontwardly as compared with the proximal end side inclined surface 107B, and the forward end side inclined surface 107A is continued to a front end of the proximal end side inclined surface 107B. In other words, the forward end side inclined surface 107A is positioned in front of and under or below the proximal end side inclined surface 107B. An angle of inclination θ1 of an obtuse angle of the forward end side inclined surface 107A with respect to a horizontal plane (plane expanding in the front-rear direction 8 and the left-right direction 9) is smaller than an angle of inclination θ2 of an obtuse angle of the proximal end side inclined surface 107B with respect to the horizontal plane. In other words, the forward end side inclined surface 107A is inclined sharply with respect to the horizontal plane as compared with the proximal end side inclined surface 107B. Note that in this embodiment, the upper surface 42A of the platen 42 and the support surface 102 are surfaces parallel to the horizontal plane.

When each of the slide members 74 is located at the rear position depicted in FIG. 13, the projection 106 is positioned at the rear side of the shaft 87. The inclined surface 107 makes contact with the shaft 87 to guide the shaft 87 in a sliding process of the slide member 74 from the rear position to the front position. When the slide member 74 is located at the front position depicted in FIG. 22, the horizontal surface 108 supports the shaft 87. When the slide member 74 is located at the front position, the upper surface of the projection 106 (inclined surface 107 and horizontal surface 108) is positioned just over the bearing 71 of the conveying roller 60 (see FIG. 5).

The projection 106 is overlapped with the retracted area in the left-right direction 9. In other words, the projection 106 is overlapped in the left-right direction 9 with a positionable space in which the movable carriage 40 is positionable. Further, an upper end of the projection 106 is positioned over or above a lower end of the carriage 40. In other words, the projection 106 is overlapped in the up-down direction 7 with the positionable space. On the other hand, the projection 106 is positioned at the rear side of the carriage 40, regardless of a slide position of the slide member 74. Therefore, the projection 106 is not overlapped in the front-rear direction 8 with the positionable space. According to the above, the projection 106 is overlapped in the left-right direction 9 and in the up-down direction 7 with the positionable space, but the projection 106 is located at the position at which the projection 106 is offset rearwardly from the positionable space in the front-rear direction 8. Therefore, the projection 106 is located at the position which is different from the positionable space in which the movable carriage 40 is positionable, regardless of the position of the slide member 74.

As depicted in FIG. 13, the support surface 102 is positioned in front of the protrusion 101. The support surface 102 is a surface which expands in the front-rear direction 8 and the left-right direction 9. The support surface 102 supports the contact piece 47 of the platen 42 from therebelow, regardless of the position of the slide member 74.

As depicted in FIGS. 5 and 13, the inclined surface 103 is positioned in front of the support surface 102. The inclined surface 103 is inclined upwardly toward the front.

The inclined surface 103 is provided with a lower inclined surface 103A and an upper inclined surface 103B. The upper inclined surface 103B is positioned in front of the lower inclined surface 103A, and the upper inclined surface 103B is continued to a front end of the lower inclined surface 103A. In other words, the upper inclined surface 103B is positioned in front of and over or above the lower inclined surface 103A. An angle of inclination θ3 of an obtuse angle of the upper inclined surface 103B with respect to a horizontal plane (plane expanding in the front-rear direction 8 and the left-right direction 9) is smaller than an angle of inclination θ4 of an obtuse angle of the lower inclined surface 103A with respect to the horizontal plane. In other words, the upper inclined surface 103B is inclined sharply with respect to the horizontal plane as compared with the lower inclined surface 103A. Note that in this embodiment, the upper surface 42A of the platen 42 and the support surface 102 are surfaces parallel to the horizontal plane.

When the slide member 74 is located at the rear position depicted in FIG. 13, the inclined surface 103 is positioned at the rear side of the projection 50 of the platen 42. As depicted in FIG. 19, the inclined surface 103 makes contact with the projection 50 to guide the projection 50 in the sliding process of the slide member 74 from the rear position to the front position. Accordingly, the platen 42 is rotated from the printing position (see FIG. 11) to the release position (see FIG. 20).

Figure 16:
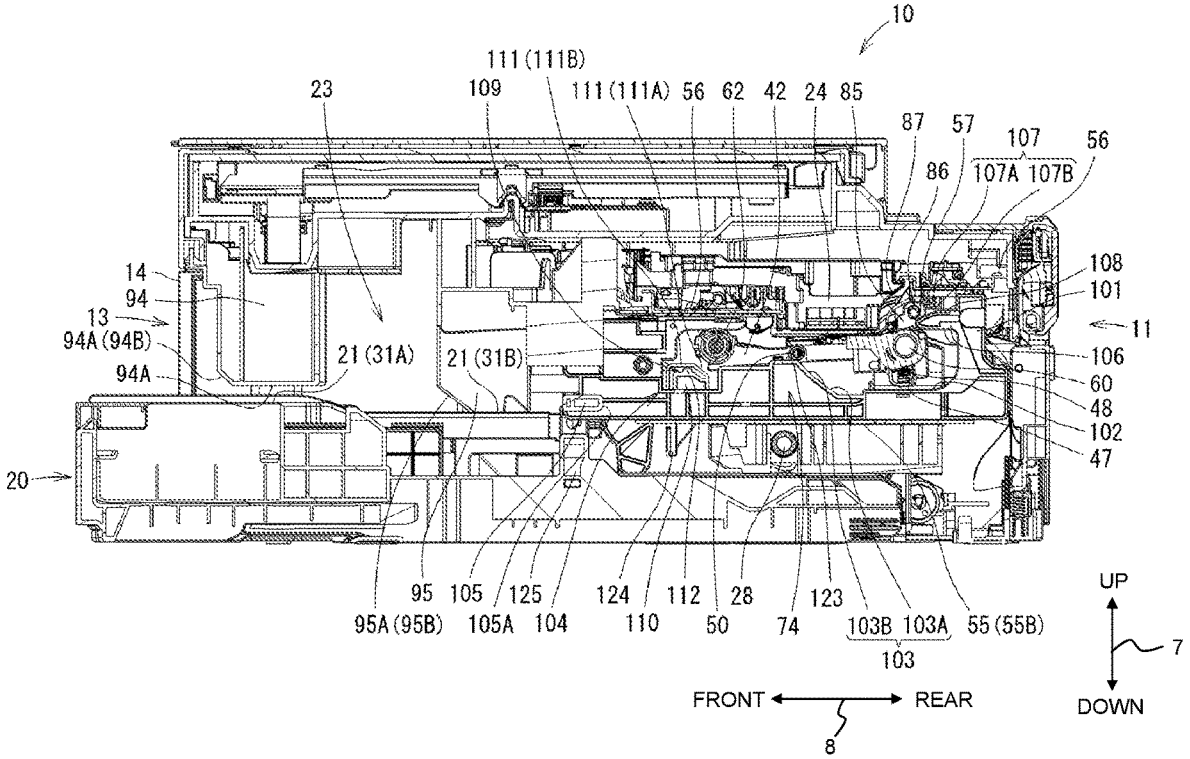
FIG. 16 is a vertical cross-sectional view depicting the printer part at a position at which the right side surface of the platen is viewed in a case that the feed tray makes contact with the lever from therebehind.

As depicted in FIGS. 5 and 13, the horizontal surface 123 extends frontwardly from a front end of the upper inclined surface 103B of the inclined surface 103. When the slide member 74 is located at the rear position depicted in FIG. 13, then the horizontal surface 123 is positioned under or below the projection 50 of the platen 42, and the horizontal plane 123 is separated from the projection 50. As depicted in FIG. 16, the horizontal surface 123 makes contact with the projection 50 to guide the projection 50 toward the inclined surface 103 in the sliding process of the slide member 74 from the rear position to the front position.

As depicted in FIGS. 5 and 13, the protrusion 104 is positioned in front of the horizontal plane 123. The protrusion 104 is positioned under or below the discharge roller 62. In other words, the protrusion 104 protrudes upwardly toward the discharge roller 62 from the upper surface of the slide member 74.

The protrusion 104 is hollowed by a through-hole 109 which penetrates the protrusion 104 in the left-right direction 9. Accordingly, the protrusion 104 is divided into a forward end part 111 and a proximal end part 110 with the through-hole 109 intervening therebetween.

The forward end part 111 is positioned over or above and at the rear side of the through-hole 109. The forward end part 111 is constructed to have a thin plate-shaped form provided to extend from a rear upper end portion via a front upper end portion to a front lower end portion of the protrusion 104. Accordingly, the forward end part 111 can be flexibly bent or warped in a direction crossing an extending direction thereof, and the forward end part 111 functions as a plate spring (leaf spring).

As depicted in FIG. 13, an upper surface of the forward end part 111 has an inclined surface 111A and a horizontal surface 111B. The inclined surface 111A extends upwardly further as the inclined surface 111A extends more frontwardly from a rear end of the protrusion 104. In other words, the inclined surface 111A extends toward the discharge roller 62 as the inclined surface 111A extends more frontwardly. The horizontal surface 111B is continued to a front end of the inclined surface 111A, and the horizontal surface 111B extends frontwardly from the front end of the inclined surface 111A.

The proximal end part 110 is positioned under or below and in front of the through-hole 109. The proximal end part 110 has a projection 112 which projects or protrudes upwardly and which is provided on an upper surface thereof (surface which is included in the inner surface of the through-hole 109 and which comparts a location under or below the through-hole 109). The projection 112 is positioned under or below the horizontal surface 111B of the forward end part 111. Accordingly, a vertical gap is small at a location of the through-hole 109 at which the projection 112 is provided as compared with the other location of the through-hole 109. Accordingly, a flexible bending amount of the forward end part 111 is made to be small by the projection 112.

As depicted in FIG. 5, the protrusion 105 is positioned in front of the protrusion 104 and at a forward end portion of the slide member 74. The protrusion 105 protrudes outwardly in the left-right direction 9 from the forward end portion of the slide member 74. In other words, the protrusion 105 of the slide member 74 which is included in the two slide members 74 and which is positioned on the right side protrudes rightwardly, and the protrusion 105 of the slide member 74 which is included in the two slide members 74 and which is positioned on the left side protrudes leftwardly.

Figure 9:
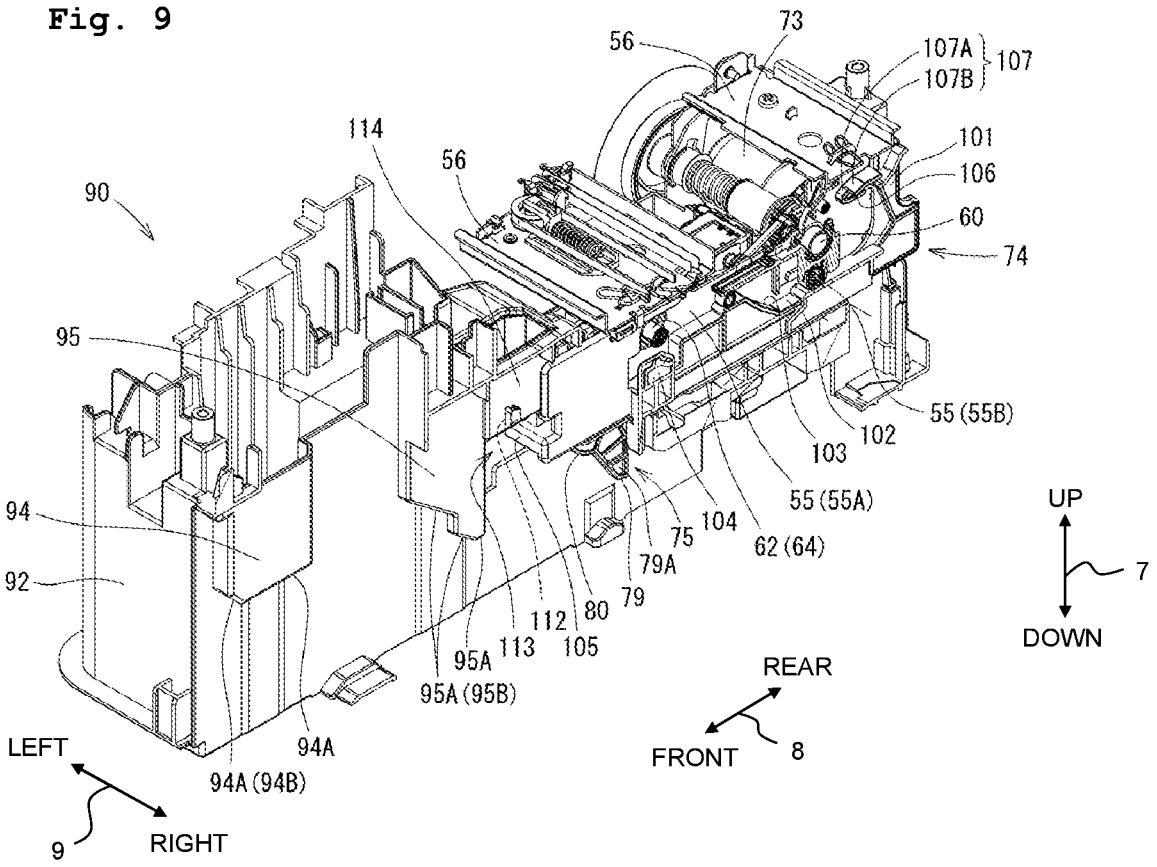
FIG. 9 is a perspective view depicting those in the vicinity of a left part of a base member.

The protrusion 105 has a projection 112 which protrudes upwardly and which is provided at the forward end portion thereof. As depicted in FIG. 9, the protrusion 105 penetrates through an opening 113 which is formed through the base member 90. Accordingly, a proximal end portion and a forward end portion (projection 112) of the protrusion 105 are positioned on the mutually opposite sides of the wall 114 of the base member 90 in the left-right direction 9. The projection 112 extends up to an upper position from the opening 113, and the projection 112 is adjacent the wall 114 in the left-right direction. Accordingly, the slide member 74 is engaged with the base member 90 by means of the protrusion 105. Note that FIG. 9 depicts the left part 92 of the base member 90. However, the right part 91 of the base member 90, which is not depicted in the drawing, is also engaged with the slide member 74 in a similar manner to the left part 92.

As depicted in FIG. 5, a proximal end portion of the protrusion 105 is longer than the forward end portion of the protrusion 105 in the front-rear direction 8. Specifically, the proximal end portion of the protrusion 105 extends to the rear side as compared with the forward end portion of the protrusion 105. The lever 75 (to be described later on) makes contact with a rear surface 105A of the proximal end portion of the protrusion 105.

As depicted in FIG. 5, the protrusion 124 is provided under or below the protrusion 104. The protrusion 124 protrudes downwardly. The feed tray 20, which is to be inserted into the casing 14, has the projected part 125 which makes contact with the protrusion 124. Accordingly, the slide member 74 slides rearwardly.

<Lever 75>

As depicted in FIG. 5, the lever 75 is supported rotatably about the shaft 76 by the side plate 55A of each of the pair of side frames 55. In other words, two pieces of the lever 75 are provided. Each of the levers 75 is positioned on the outer side of the side plate 55A in the left-right direction 9. In other words, the levers 75 are provided at the right side of the side frame 55 on the right side and at the left side of the side frame 55 on the left side.

Each of the levers 75 is supported rotatably about the shaft 76 by the base member 90 as well. In other words, each of the levers 75 is supported by both of the base member 90 and the side frame 55. The shaft 76 protrudes from the upper portion of each of the levers 75 to both of the outer side and the inner side in the left-right direction 9. As depicted in FIG. 10A, a shaft 76A, which is included in the shaft 76 and which protrudes outwardly in the left-right direction 9 from the lever 75, is inserted into a hole 77 which is formed in the base member 90. A shaft 76B, which is included in the shaft 76 and which protrudes inwardly in the left-right direction 9 from the lever 75, is inserted into an aperture 78 which is formed for the side frame 55. The diameter of the hole 77 is larger than the diameter of the aperture 78.

Figure 21:
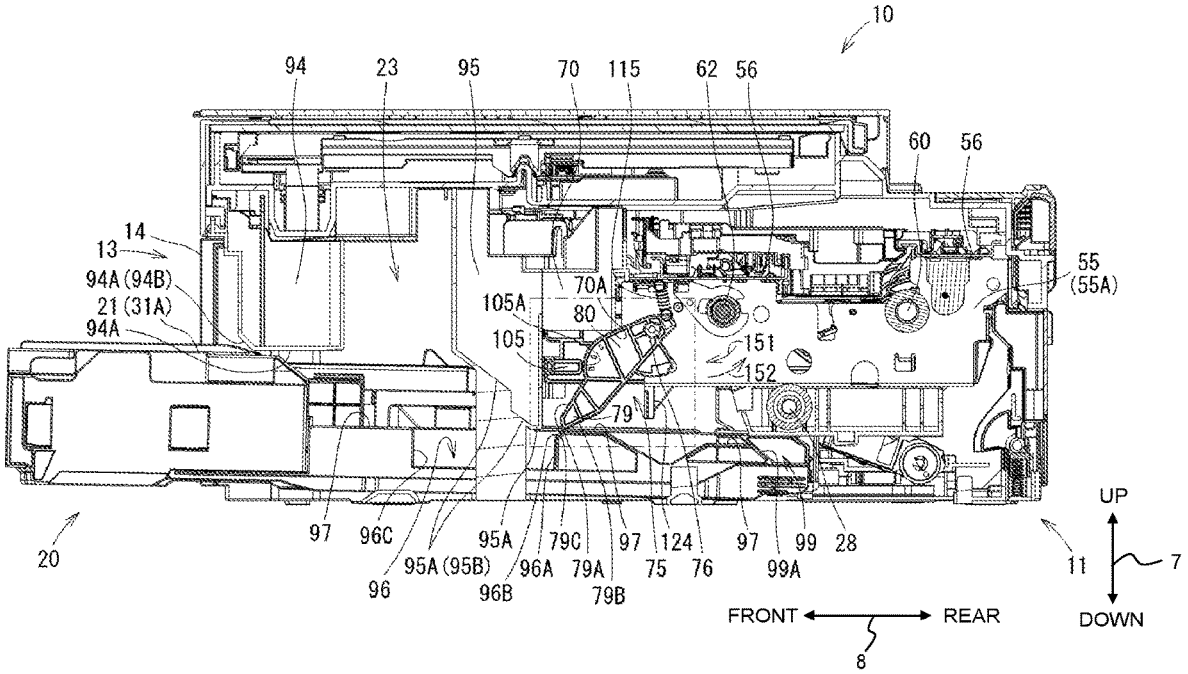
FIG. 21 is a vertical cross-sectional view depicting the printer part at a position at which the lever on the right side can be seen from a right position when the slide member is located at the front position.
Figure 24:
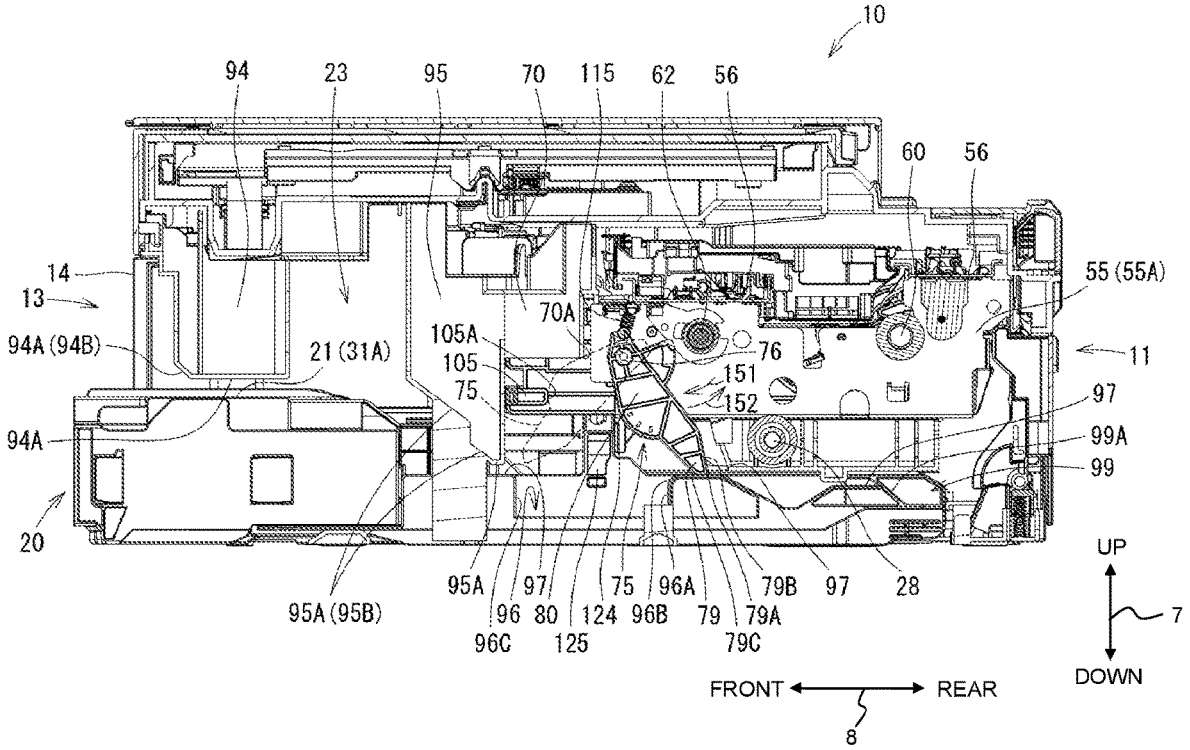
FIG. 24 is a vertical cross-sectional view depicting the printer part at a position at which the lever on the right side is viewed from a right position when the feed tray makes contact with the slide member from the front position.

The lever 75 is rotatable to s reference position depicted in FIG. 12, a front rotation position depicted in FIG. 21, and a rear rotation position depicted in FIG. 24. The lever 75 is rotatable between the front rotation position and the rear rotation position. The lever 75 is positioned at the front rotation position by being rotated in the orientation of the arrow 151 from the reference position. The lever 75 is positioned at the rear rotation position by being rotated in the orientation of an arrow 152 (orientation opposite to the arrow 151) from the reference position.

As depicted in FIG. 12, when the lever 75 is located at the reference position, a forward end part 79 of the lever 75 is positioned under or below the shaft 76. The forward end part 79 includes a forward end 79A of the lever 75 (lower end of the lever 75 when the lever is located at the reference position).

As depicted in FIG. 21, when the lever 75 is located at the front rotation position, the forward end 79A is positioned frontwardly and upwardly as compared with when the lever 75 is located at the reference position (see FIG. 12). The lever 75, which is located at the front rotation position, makes contact with the rear lower end part 70A of the third protrusion 70 of the base member 90 from the rear side. Accordingly, the lever 75, which is located at the front rotation position, is regulated for the rotation in the orientation of the arrow 151 by the rear lower end part 70A of the third protrusion 70. In other words, the lever 75, which is located at the front rotation position, is regulated for the rotation in the orientation to make separation from the reference position by the rear lower end part 70A of the third protrusion 70.

As depicted in FIG. 24, when the lever 75 is located at the rear rotation position, the forward end 79A is positioned rearwardly and upwardly as compared with when the lever 75 is located at the reference position (see FIG. 12).

As depicted in FIG. 12, a lower end of the coil spring 115 is connected to the upper end portion of the lever 75. An upper end of the coil spring 115 is connected to the projection 37 of the side frame 55 (see FIG. 10B). When the lever 75 is positioned at the reference position, the coil spring 115 has an equilibrium length. If the lever 75 is rotated from the reference position toward the front rotation position or the rear rotation position, the coil spring 115 is expanded or shrunk. Accordingly, the lever 75 is biased toward the reference position by the elastic force of the coil spring 115.

The lever 75 is provided over or above the side wall 30 and at a same position as that of the side wall 30 of the feed tray 20 in the left-right direction 9. As depicted in FIG. 12, when the lever 75 is positioned at the reference position, the forward end part 79 of the lever 75 enters into the cutout 96 formed for the side wall 30 of the feed tray 20.

When the lever 75 is positioned at the reference position, the forward end part 79 of the lever 75 (portion of the lever 75 entering into the cutout 96) is positioned at the rear side of the shaft 76. The forward end part 79 has a rear surface 79B and a front surface 79C. The rear surface 79B is brought into contact with the rear surface 96A and the inclined surface 96B of the feed tray 20 to be moved frontwardly during a process of withdrawing (removing) the feed tray 20 from the casing 14 (see FIGS. 15 and 18). The front surface 79C makes contact with the inclined surface 99A of the side wall 30 of the feed tray 20 which is being inserted into the casing 14 (see FIGS. 4 and 12).

As depicted in FIG. 12, the lever 75 has a protrusion 80. The protrusion 80 protrudes in the orientation of the arrow 151 from a virtual surface 153 expanding in an orientation directed from the shaft 76 to the forward end 79A and in the left-right direction 9. The arrow 151 indicates an orientation in which the lever 75 is rotated toward the contact position with respect to the slide member 74 (position of the rear surface 105A of the protrusion 105). A protruding end surface 80A of the protrusion 80 is curved.

As depicted in FIG. 12, the lever 75 located at the rear rotation position (indicated by broken lines in FIG. 12) is positioned in front of the rear surface 96A of the cutout 96 of the feed tray 20 located at the position (position depicted in FIG. 12) at which the feed tray 20 is installed to the casing 14.

As depicted in FIG. 24, the lever 75 located at the front rotation position (indicated by broken lines in FIG. 24) is positioned at the rear side of the front surface 96C of the cutout 96 of the feed tray 20 at a predetermined position (position depicted in FIG. 24). The predetermined position is a position at which the feed tray 20 is located provided that the slide member 74 (in particular, the rear surface 105A of the protrusion 105) makes contact with the lever 75 located at the front rotation position under a condition that the lever 75 is positioned at the front rotation position in the process in which the feed tray 20 is inserted into the casing 14.

Figure 27:
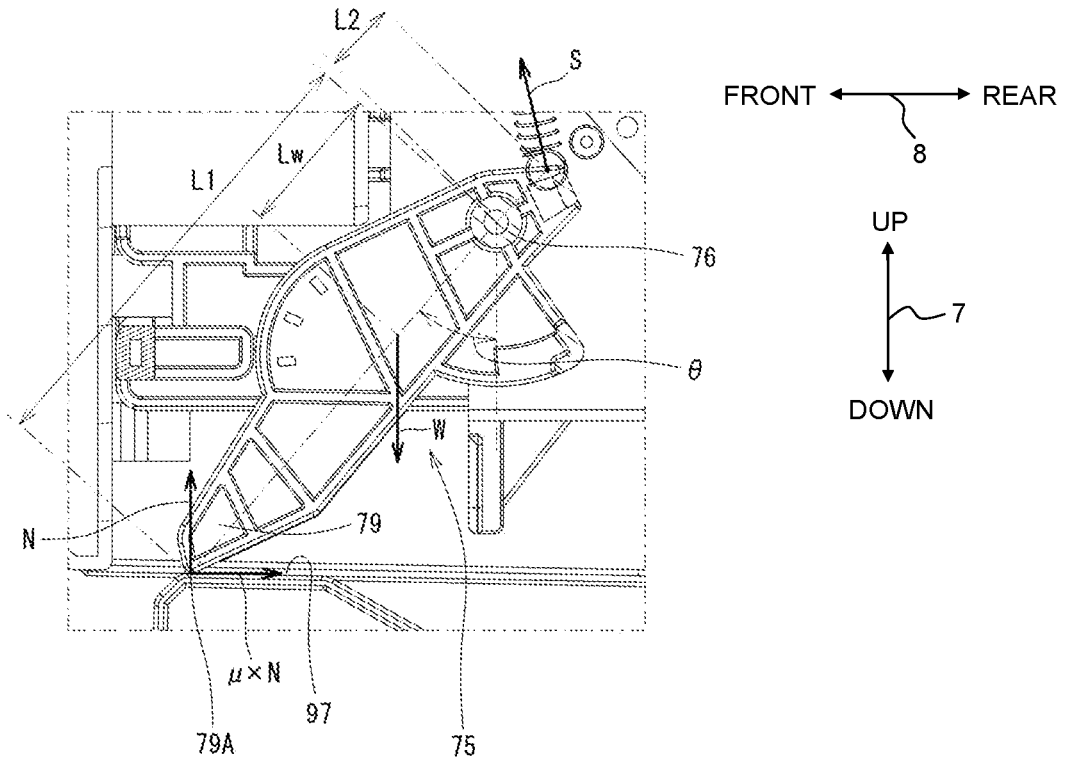
FIG. 27 is an enlarged view of the lever and those in the vicinity of the lever in FIG. 21.

An angle of rotation θ (unit: degree) of the lever 75 toward the front side and the rear side with respect to the vertical direction (see FIG. 27) fulfills the following relationship of Expression 1 in a state in which the lever 75 makes contact with the upper surface 97 of the side wall 30 of the feed tray 20 (for example, a state depicted in FIG. 27). In Expression 1, "μ" represents the coefficient of friction between the forward end 79A of the lever 75 and the upper surface 97 of the feed tray 20 (see FIG. 27).

$$\theta > \arctan \mu \quad \text{(Expression 1)}$$

Expression 1 is derived as follows. As depicted in FIG. 27, the balance of moments around the shaft 76 of the lever 75 is expressed by Expression 2 as follows.

$$W \times Lw \times \sin \Theta - N \times L1 \times \sin \theta + \mu \times N \times L1 \times \cos \theta + L2 \times S = 0 \quad \text{(Expression 2)}$$

In Expression 2, "W" (unit: N) is the own weight of the lever 75. "Lw" (unit: mm) is a distance from the shaft 76 of the lever 75 to the center of gravity of the lever 75. "N" (unit: N) is the vertical drag acting on the forward end 79A of the lever 75 from the upper surface 97 of the feed tray 20. "L1" (unit: mm) is a distance from the shaft 76 of the lever 75 to the forward end 79A of the lever 75. "L2" (unit: mm) is a distance from the shaft 76 of the lever 75 to the connecting position of the lever 75 and the coil spring 115. "S" (unit: N) is the force acting on the coil spring 115.

In a case that Expression 2 is deformed, Expression 3 is obtained as follows.

$$N = (W \times Lw \times \sin \theta + L2 \times S)/(L1 \times (\sin \theta - \mu \cos \theta)) \quad \text{(Expression 3)}$$

According to Expression 3, if $\sin \theta - \mu \cos \theta = 0$ is given, N is infinite. Accordingly, if it is intended to move the feed tray 20 frontwardly from the state depicted in FIG. 27, the frontward movement of the feed tray 20 is inhibited by the lever 75. In order to avoid this situation, it is appropriate that $\sin \theta - \mu \cos \theta > 0$ is given. In other words, it is appropriate that Expression 1 is fulfilled. Note that the relationship, which is fulfilled by the angle of rearward and upward rotation of the lever 75 with respect to the vertical direction, can be also decided in a similar manner to that described above.

<Operations of Respective Members in Insertion/Withdrawal Process of Feed Tray 20>

An explanation will be made below about states and operations of the respective members in a process in which the feed tray 20 is inserted/withdrawn (pulled our) with respect to the casing 14.

At first, an explanation will be made about the states and the operations of the respective members in the process in which the feed tray 20 is withdrawn (pulled out) from the casing 14.

As depicted in FIGS. 11 to 13, when the feed tray 20 is installed to the casing 14, the respective members are in the states described in detail below.

As depicted in FIG. 12, the lever 75 is positioned at the reference position. The protrusion 80 of the lever 75 makes contact with the rear surface 105A of the protrusion 105 of the slide member 74 from therebehind. Note that in this situation, the lever 75 may be separated from the rear surface 105A of the protrusion 105 of the slide member 74.

As depicted in FIG. 13, the slide member 74 is positioned at the rear position. The projection 106 is positioned at the rear side of the shaft 87, and the projection 106 is separated from the shaft 87. In this situation, the pinch roller 61 makes contact with the conveying roller 60 by being biased by the coil spring 57 (see FIGS. 2 and 5). In other words, the conveying roller pair 59 is in the nipping state.

As depicted in FIG. 12, the rear surface 96A of the cutout 96 of the feed tray 20 is positioned at the rear side of the lever 75 located at the reference position. The rear surface 96A of the cutout 96 of the feed tray 20 is positioned at the rear side of the lever 75 located at the rear rotation position indicated by the broken line in FIG. 12. The front surface 96C of the cutout 96 of the feed tray 20 is positioned in front of the lever 75 located at the reference position. The forward end part 79 of the lever 75 is positioned under or below the upper surface 97 of the side wall 30, and the forward end part 79 of the lever 75 enters the cutout 96.

The first protrusion 94 of the base member 90 is opposed in the up-down direction 7 to the front upper surface 31A of the discharge tray 21. The second protrusion 95 of the base member 90 is opposed in the up-down direction 7 to the horizontal surface 97A of the upper surface 97 of the side wall 30 of the feed tray 20. Therefore, when the feed tray 20 is lifted upwardly by the user in the state depicted in FIGS. 11 to 13, the lifting of the feed tray 20 is regulated by the contact of the front upper surface 31A with or against the lower surface 94A of the first protrusion 94 from the lower position, or by the contact of the horizontal surface 97A with or against the lower surface 95A of the second protrusion 95 from the lower position.

As depicted in FIGS. 11 and 13, the platen 42 is positioned at the printing position. The platen 42 is definitely positioned in the up-down direction 7 as described in detail below.

As depicted in FIG. 13, the contact piece 47, which is provided at the rear end portion of the platen 42, is supported by the support surface 102 of the slide member 74. The projected part 46 is positioned over or above the support surface 102 (see FIG. 6). The bearing 71 of the conveying roller 60 (see FIG. 5) is fitted to the recess formed by the upper surface 46A of the projected part 46. In this situation, the projected part 46 is biased upwardly by the coil spring 48, and the projected part 46 is pressed against the bearing 71 of the conveying roller 60. In other words, the platen 42 is biased with respect to the conveying roller 60. Accordingly, the rear end portion of the platen 42 is definitely positioned in the up-down direction 7 by the side frame 55 to which the bearing 71 is attached.

The projected part 49, which is provided at the front end portion of the platen 42, is supported by the forward end part 111 of the protrusion 104 of the slide member 74. In this situation, the projected part 49 is biased upwardly by the forward end part 111 which functions as the plate spring, and the projected part 49 is pressed against the discharge roller 62. In other words, the projected part 49 is in a state of being vertically sandwiched or interposed by the protrusion 104 and the discharge roller 62. Accordingly, the front end portion of the platen 42 is definitely positioned in the up-down direction 7 by the side frame 55 by which the discharge roller 62 is supported by the aid of the bearing 72. As described above, the platen 42 is definitely positioned in the up-down direction 7 by definitely positioning the rear end portion and the front end portion thereof by the side frame 55.

Note that even when the slide member 74 is moved from the rear position depicted in FIG. 13 to the front position depicted in FIG. 22, the contact piece 47 maintains the state of being supported by the slide member 74. Therefore, the projected part 46 is biased upwardly by the coil spring 48 regardless of the position of the slide member 74, and the projected part 46 is pressed against the bearing 71. Accordingly, the platen 42 is rotatable about the bearing 71 (about the axis of the conveying roller 60) regardless of the position of the slide member 74.

As depicted in FIG. 13, the projection 50 of the platen 42 is separated from the slide member 74. In other words, the projection 50 is not supported by the slide member 74.

Figure 14:
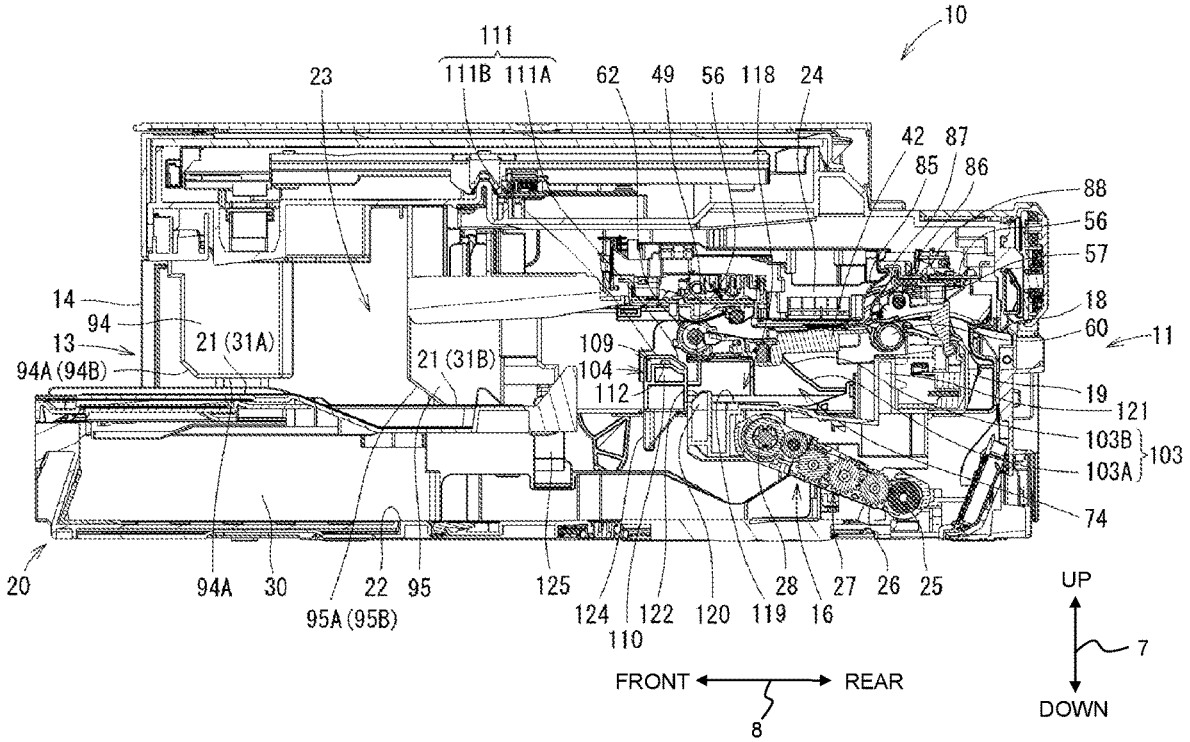
FIG. 14 is a vertical cross-sectional view taken along the center in the left-right direction of the printer part in a case that the feed tray makes contact with or abuts against the lever from a back or rear position or from therebehind.
Figure 15:
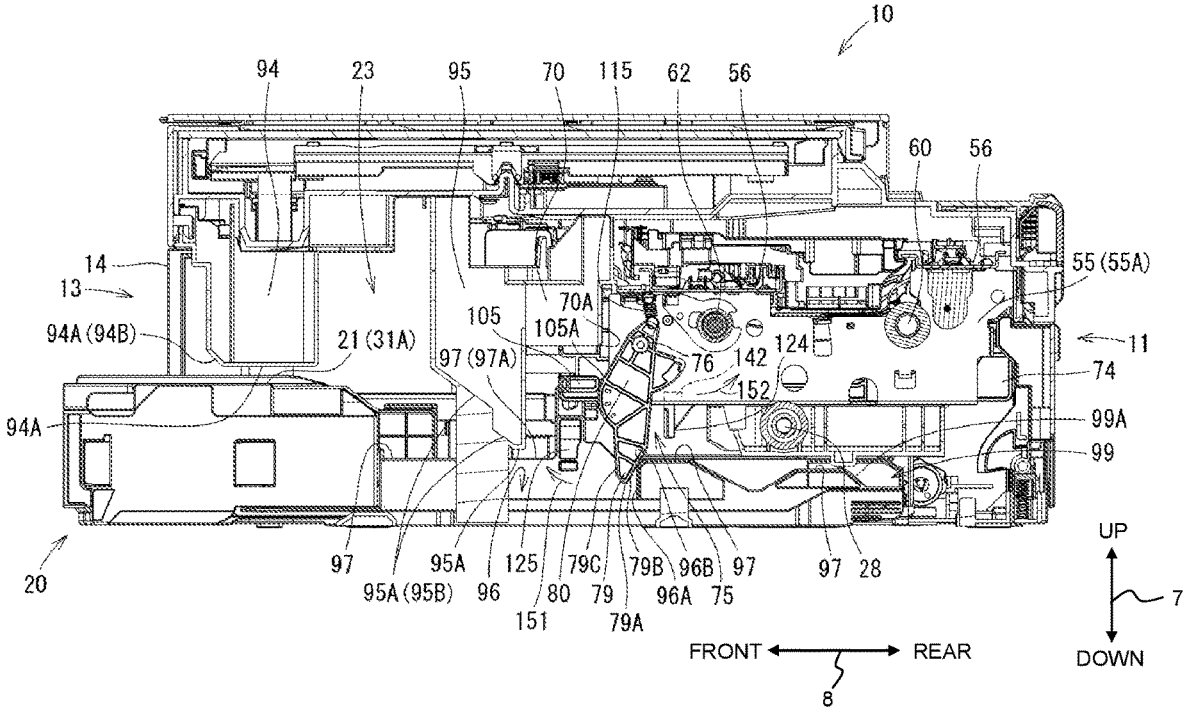
FIG. 15 is a vertical cross-sectional view depicting the printer part at a position at which the lever on the right side is viewed from a right position in a case that the feed tray makes contact with the lever from therebehind.

When the withdrawal of the feed tray 20 from the casing 14 is started, the feed tray 20 is moved frontwardly from the position depicted in FIGS. 11 to 13 to the position depicted in FIGS. 14 to 16. In this situation, the respective members are operated as described in detail below, and the respective members are in the states described in detail below.

As depicted in FIG. 15, the rear surface 96A of the cutout 96 of the feed tray 20 makes contact with the rear surface 79B of the forward end part 79 of the lever 75 from the rear side, and the rear surface 96A pushes the lever 75 frontwardly. Accordingly, the lever 75 is pushed by the feed tray 20, and the lever 75 is rotated in the orientation of the arrow 151 from the reference position, i.e., from the reference position toward the side of the front rotation position against the biasing force of the coil spring 115. The protrusion 80 of the rotating lever 75 pushes the rear surface 105A of the protrusion 105 of the slide member 74 frontwardly. Accordingly, the slide member 74 slides frontwardly from the rear position, i.e., from the rear position toward the front position.

The first protrusion 94 of the base member 90 is opposed in the up-down direction 7 to the front upper surface 31A of the discharge tray 21. The front portion of the second protrusion 95 of the base member 90 is opposed in the up-down direction 7 to the horizontal surface 97A of the upper surface 97 of the side wall 30 of the feed tray 20. The rear portion of the second protrusion 95 of the base member 90 is opposed in the up-down direction 7 to the cutout 96 of the feed tray 20. Therefore, when the feed tray 20 is lifted upwardly by the user during the frontward movement of the feed tray 20, the lifting of the feed tray 20 is regulated by the contact of the front upper surface 31A with or against the lower surface 94A of the first protrusion 94 from the lower position, or by the contact of the horizontal surface 97A with or against the lower surface 95A of the second protrusion 95 from the lower position.

As depicted in FIGS. 14 and 16, the platen 42 is rotated downwardly from the printing position. In other words, the platen 42 is rotated from the printing position toward the release position. A description will be made in detail below.

The state, in which the projected part 46 is pressed against the bearing 71, is maintained. Therefore, the platen 42 maintains the state in which the platen 42 is rotatable about the axis of the conveying roller 60.

On the other hand, the protrusion 104 of the slide member 74 is separated from the projected part 49 by allowing the slide member 74 to slide frontwardly. Accordingly, the projected part 49 is not supported by the protrusion 104. As a result, the platen 42 is rotated about the axis of the conveying roller 60 so that the forward end portion thereof is moved downwardly, and the projected part 49 of the platen 42 is separated from the bearing 72. After that, as depicted in FIG. 16, when the platen 42 is rotated, then the projection 50 is moved downwardly, the projection 50 makes contact with the horizontal surface 123 of the slide member 74 from the upper position, and the projection 50 is guided by the horizontal surface 123. After that, the projection 50 is guided by the inclined surface 103 and the horizontal surface 123 of the slide member 74 in accordance with the frontward sliding movement of the slide member 74, and thus the platen 42 is rotated toward the release position.

Note that the protrusion 104 of the slide member 74 is separated from the projected part 49, and thus the front end portion of the platen 42 is not definitely positioned in the up-down direction 7.

In the state depicted in FIGS. 14 to 16, the projection 106 is still positioned at the rear side of the shaft 87, and the projection 106 is separated from the shaft 87. Therefore, the conveying roller pair 59 is still in the nipping state.

When the feed tray 20 is moved frontwardly from the position depicted in FIGS. 14 to 16 to the position depicted in FIGS. 17 to 19, then the respective members are operated as described in detail below, or the respective members are in states described in detail below.

Figure 18:
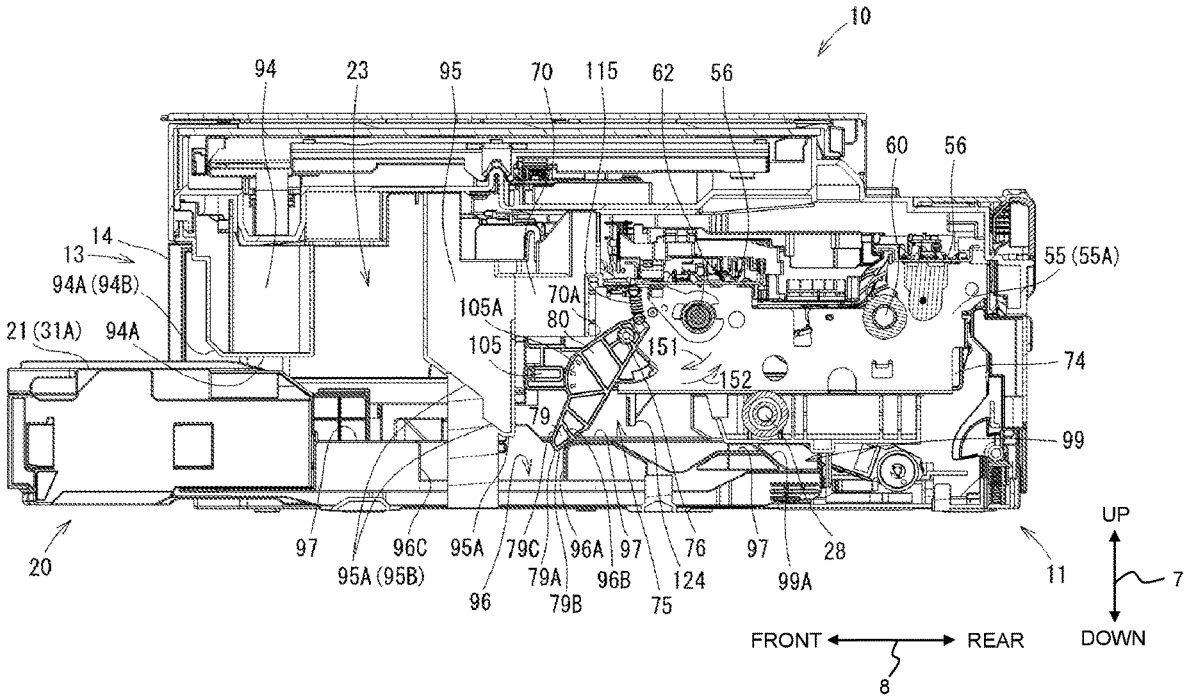
FIG. 18 is a vertical cross-sectional view depicting the printer part at a position at which the lever on the right side can be seen from a right position in the state that the conveying roller pair is changed to be in the separated state.

As depicted in FIG. 18, the lever 75 is pushed by the feed tray 20, and the lever 75 is rotated in the orientation of the arrow 151 from the position depicted in FIG. 15, i.e., toward the side of the front rotation position. As depicted in FIG. 19, the slide member 74 is pushed by the rotating lever 75, and the slide member 74 slides frontwardly as compared with the position depicted in FIG. 16, i.e., toward the side of the front position.

Figure 17:
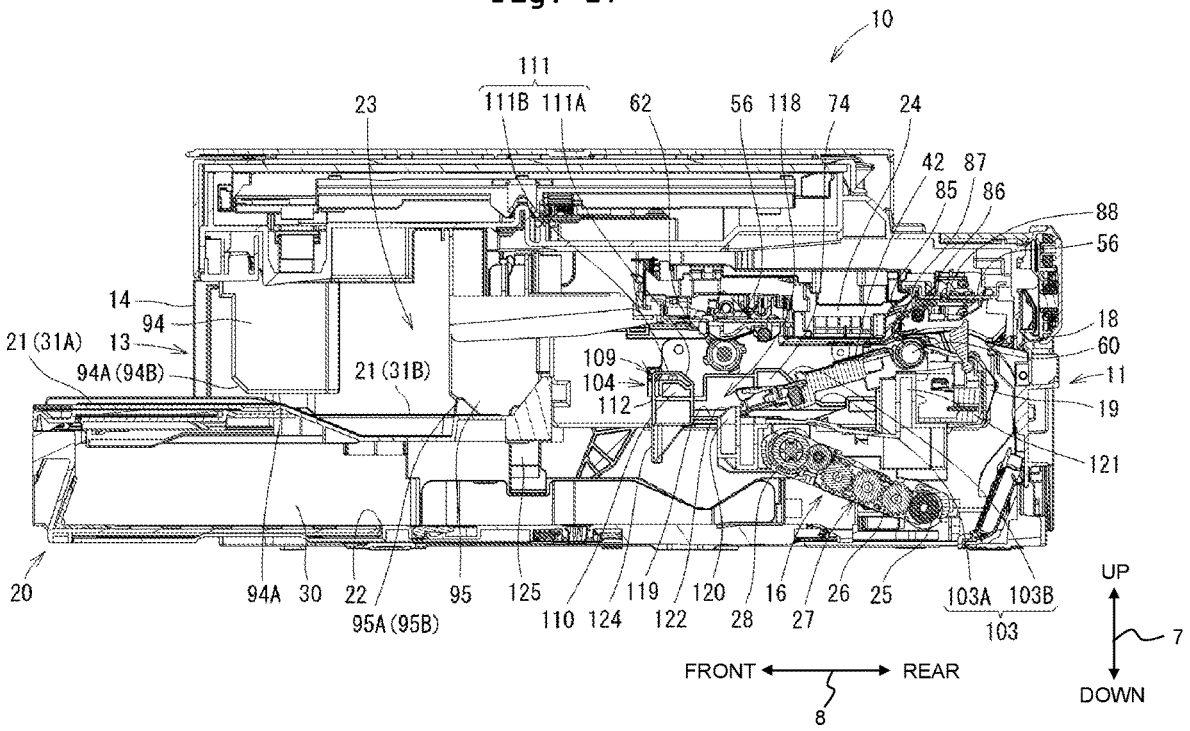
FIG. 17 is a vertical cross-sectional view taken along the center in the left-right direction of the printer part in a state that a conveying roller pair is changed to be in a separated state.

As depicted in FIG. 19, the projection 106 makes contact with the shaft 87 from the rear position, and the inclined surface 107 of the projection 106 guides the shaft 87 upwardly in the process in which the slide member 74 slides frontwardly from the position depicted in FIGS. 14 to 16 to the position depicted in FIGS. 17 to 19. Accordingly, the shaft 87 is moved upwardly against the biasing force of the coil spring 57 (see FIG. 16). The shaft 87, which moves upwardly, pushes upwardly the surface of the roller holder 85 which comparts the through-hole 86. Accordingly, the roller holder 85 and the pinch roller 61 are moved upwardly, and the pinch roller 61 is separated from the conveying roller 60. As a result, the conveying roller pair 59 is changed from the nipping state to the separated state.

The guide of the shaft 87 by the inclined surface 107 is started after starting the guide of the projection 50 by the inclined surface 103 and the horizontal surface 123 of the slide member 74. Further, the platen 42 does not arrive at the release position yet at a point in time at which the change of the conveying roller pair 59 from the nipping state to the separated state is completed. In other words, the rotation of the platen 42 from the printing position to the release position is completed after the completion of the change of the conveying roller pair 59 from the nipping state to the separated state.

The shaft 87 is firstly guided by the forward end side inclined surface 107A, and then the shaft 87 is guided by the proximal end side inclined surface 107B in the process in which the shaft 87 is guided by the inclined surface 107. The shaft 87, which is in the situation of being guided by the proximal end side inclined surface 107B, is positioned upwardly as compared with the shaft 87 which is in the situation of being guided by the forward end side inclined surface 107A. In other words, the pinch roller 61, which is in such a situation that the forward end side inclined surface 107A makes contact with the shaft 87, is positioned near to the conveying roller 60 as compared with the pinch roller 61 which is in such a situation that the proximal end side inclined surface 107B makes contact with the shaft 87. Therefore, the coil spring 57, which is in such a situation that the shaft 87 is guided by the proximal end side inclined surface 107B, is elongated further as compared with the coil spring 57 which is in such a situation that the shaft 87 is guided by the forward end side inclined surface 107A, wherein the large elastic force acts as the resistance force against the guide of the shaft 87. In this case, the proximal end side inclined surface 107B is inclined gently with respect to the horizontal plane as compared with the forward end side inclined surface 107A. In other words, when the large elastic force acts, the shaft 87 is guided by the gentle proximal end side inclined surface 107B. Therefore, it is possible to decrease the load exerted on the shaft 87. On the other hand, when the large elastic force does not act, the shaft 87 is guided by the steep forward end side inclined surface 107A. Therefore, the shaft 87 can quickly move upwardly.

When the slide member 74 is located at the position depicted in FIGS. 17 to 19, then the shaft 87 passes over the inclined surface 107 of the projection 106, and the shaft 87 is supported by the horizontal surface 108 of the projection 106.

As for the discharge roller pair 44, the discharge roller 62 and the spur 63 are not separated from each other, unlike the conveying roller pair 59. In other words, the discharge roller 62 and the spur 63 make contact with each other regardless of the positions of the slide member 74 and/or the platen 42, and the discharge roller 62 and the spur 63 maintain the nipping state capable of nipping the sheet 12.

As depicted in FIG. 18, the first protrusion 94 of the base member 90 is opposed in the up-down direction 7 to the front upper surface 31A of the discharge tray 21. The second protrusion 95 of the base member 90 is opposed in the up-down direction 7 to the cutout 96 of the feed tray 20. Therefore, when the feed tray 20 is lifted upwardly by the user during the frontward movement of the feed tray 20, then the front upper surface 31A makes contact with the lower surface 94A of the first protrusion 94 from the lower position, and thus the lifting of the feed tray 20 is regulated.

As depicted in FIG. 19, the platen 42 is rotated so that the forward end portion thereof is positioned further downwardly, i.e., the platen 42 is further rotated toward the release position by allowing the projection 50 to be guided by the inclined surface 103 of the slide member 74, in the process in which the slide member 74 slides frontwardly from the position depicted in FIGS. 14 to 16 to the position depicted in FIGS. 17 to 19.

The projection 50 is firstly guided by the upper inclined surface 103B, and then the projection 50 is guided by the lower inclined surface 103A in the process in which the projection 50 is guided by the inclined surface 103. The projection 50, which is in the situation of being guided by the lower inclined surface 103A, is positioned downwardly as compared with the projection 50 which is in the situation of being guided by the upper inclined surface 103B. Therefore, the coil spring 48, which is in such a situation that the projection 50 is guided by the lower inclined surface 103A, is shrunk as compared with the coil spring 48 which is in such a situation that projection 50 is guided by the upper inclined surface 103B, wherein the large elastic force acts as the resistance force against the guide of the projection 50. In this case, the lower inclined surface 103A is inclined gently with respect to the horizontal plane as compared with the upper inclined surface 103B. In other words, when the large elastic force acts, the projection 50 is guided by the gentle lower inclined surface 130A. Therefore, it is possible to decrease the load exerted on the projection 50. On the other hand, when the large elastic force does not act, the projection 50 is guided by the steep upper inclined surface 103B. Therefore, the platen 42 can be quickly rotated toward the release position.

When the feed tray 20 is moved frontwardly from the position depicted in FIGS. 17 to 19 to the position depicted in FIGS. 20 to 22, then the respective members are operated as described in detail below, or the respective members are in states described in detail below.

As depicted in FIG. 21, the lever 75 is pushed by the feed tray 20, the lever 75 is moved in the orientation of the arrow 151 from the position depicted in FIG. 18, and the lever 75 is positioned at the front rotation position. In this situation, the lever 75 is positioned outside the cutout 96. The forward end 79A of the lever 75 is supported by the horizontal surface 97A of the upper surface 97 of the side wall 30 of the feed tray 20. The lever 75 can smoothly move to the outside of the cutout 96 by allowing the forward end 79A of the lever 75 to be guided by the inclined surface 96B of the rear surface 96A of the cutout 96. The lever 75, which is located at the front rotation position, makes contact with the rear lower end part 70A of the third protrusion 70 of the base member 90. Accordingly, the rotation in the orientation of the arrow 151 of the lever 75 at the front rotation position is regulated.

As depicted in FIG. 22, the slide member 74 is pushed by the rotating lever 75, the slide member 74 slides frontwardly from the position depicted in FIGS. 17 to 19, and the slide member 74 is positioned at the front position.

The conveying roller pair 59 is in the separated state.

As depicted in FIG. 21, the front portion of the first protrusion 94 of the base member 90 is opposed in the up-down direction 7 to the front upper surface 31A of the discharge tray 21. The rear portion of the first protrusion 94 of the base member 90 is opposed in the up-down direction 7 to the rear upper surface 31B of the discharge tray 21. The second protrusion 95 of the base member 90 is opposed in the up-down direction 7 to the cutout 96 of the feed tray 20. Therefore, when the feed tray 20 is lifted upwardly by the user during the frontward movement of the feed tray 20, then the front upper surface 31A makes contact with the lower surface 94A of the first protrusion 94 from the lower position, and thus the lifting of the feed tray 20 is regulated.

Note that when the feed tray 20 is further moved frontwardly from the position depicted in FIG. 21, the rear surface 96A, which is the rear end of the cutout 96, is located at the same position in the front-rear direction 8 as that of the rear end of the lower surface 95A of the second protrusion 95. In this situation, the rear end of the front upper surface 31A of the discharge tray 21 is still positioned rearwardly as compared with the front end of the lower surface 94A of the first protrusion 94. In other words, when the rear surface 96A, which is the rear end of the cutout 96, is positioned rearwardly from the rear end of the lower surface 95A of the second protrusion 95, the rear end of the front upper surface 31A of the discharge tray 21 is positioned rearwardly from the front end of the lower surface 94A of the first protrusion 94. That is, the first protrusion 94 is opposed in the up-down direction 7 to the front upper surface 31A of the discharge tray 21 in the state in which the second protrusion 95 is opposed in the up-down direction 7 to the cutout 96. Accordingly, when the feed tray 20 is lifted upwardly by the user, then the front upper surface 31A makes contact with the lower surface 94A of the first protrusion 94 from the lower position, and thus the second protrusion 95 is suppressed from deeply entering the cutout 96.

As depicted in FIGS. 20 and 22, the platen 42 is rotated so that the forward end portion thereof is positioned further downwardly and the platen 42 is positioned at the release position by allowing the projection 50 to be guided by the inclined surface 103 of the slide member 74 in the process in which the slide member 74 slides frontwardly from the position depicted in FIGS. 17 to 19 to the position depicted in FIGS. 20 to 22.

As depicted in FIG. 20, the platen 42, which is located at the release position, is positioned rearwardly (upstream in the conveying orientation 15) from the wall 120 of the base member 90. The lower portion of the front end portion of the platen 42 enters the recess 118 of the base member 90. The platen 42 is supported by the surface 119 of the base member 90. In this embodiment, the plate member 83, which is attached to the platen 42, makes contact with the surface 119 from the upper position, and thus the plate member 83 is supported by the surface 119. Accordingly, the platen 42 is supported by the base member 90.

The platen 42, which is located at the release position, is positioned below the virtual plane 129 including the inclined surface 122 of the wall 120 of the base member 90 (surface which is inclined upwardly toward the rear in the same manner as the inclined surface 122). In other words, the virtual plane 129 covers the platen 42 located at the release position from the upper position.

After that, although not depicted, the feed tray 20 is further moved frontwardly, and the feed tray 20 is withdrawn (pulled out) from the casing 14. In this situation, when the feed tray 20 is lifted upwardly by the user during the frontward movement of the feed tray 20, then the inclined surface 31C and the rear upper surface 31B of the discharge tray 21 and the horizontal surface 97A of the upper surface 97 of the side wall 30 of the feed tray 20 make contact with the lower surface 94A of the first protrusion 94 from the lower positions, and thus the lifting of the feed tray 20 is regulated. When the lever 75 is not supported by the feed tray 20 by further moving the feed tray 20 frontwardly, then the lever 75 is biased by the coil spring 115, and the lever 75 is rotated to the reference position.

Next, an explanation will be made about the operations and the states of the respective members in the process in which the feed tray 20 is inserted into the casing 14. Note that the operations of the respective members in the process in which the feed tray 20 is inserted into the casing 14 (hereinafter referred to as "operations during the insertion") are the operations which are generally converse to the operations of the respective members in the process in which the feed tray 20 is withdrawn (pulled out) from the casing 14 (hereinafter referred to as "operations during the withdrawal (pulling-out)"). On this account, the following explanation will be made as follows. That is, if the operation during the insertion is the operation converse to the operation during the withdrawal, the explanation about the operation will be simplified or omitted. If the operation during the insertion is different from the operation which is converse to the operation during the withdrawal, the operation will be explained in detail.

When the rear end portion of the side wall 30 of the feed tray 20 approaches the lever 75 located at the reference position in the process in which the feed tray 20 is inserted into the casing 14 by being moved rearwardly with respect to the casing 14, the lever 75 enters the recess 99 at the rear end portion of the side wall 30 of the feed tray 20 (see FIG. 12). When the feed tray 20 is moved further rearwardly, the inclined surface 99A of the feed tray 20 (see FIG. 12) makes contact with the front surface 79C of the forward end part 79 of the lever 75 located at the reference position from the front side. The front surface 79C of the forward end part 79 of the lever 75 is pushed rearwardly by the inclined surface 99A of the feed tray 20. Accordingly, the lever 75 is rotated in the orientation of the arrow 152 from the reference position, i.e., in the direction directed from the reference position to the side of the rear rotation position. After that, the lever 75 passes over the inclined surface 99A in accordance with the rearward movement of the feed tray 20, and then the lever 75 is guided by the upper surface 97. In this situation, the lever 75 is guided while being rotated in the orientation of the arrow 151 or the arrow 152 depending on the height of the upper surface 97 with which the lever 75 makes contact.

Figure 23:
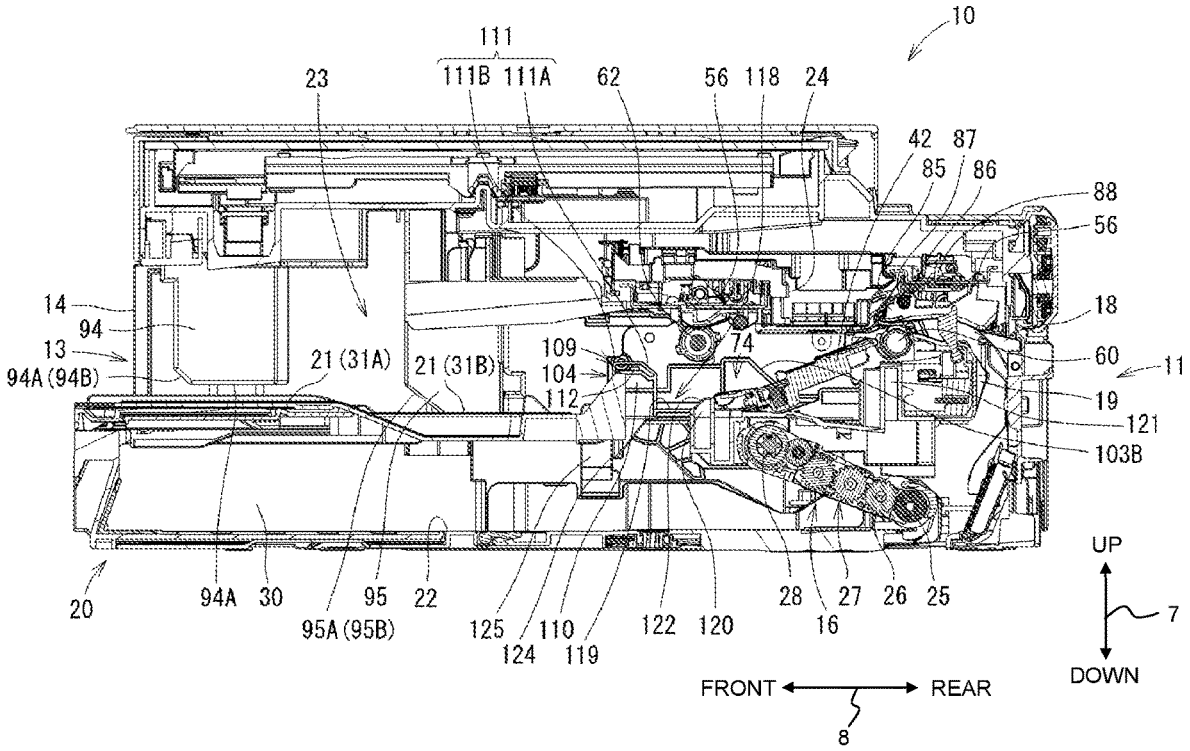
FIG. 23 is a vertical cross-sectional view taken along the center in the left-right direction of the printer part when the feed tray makes contact with the slide member from a front position.
Figure 25:
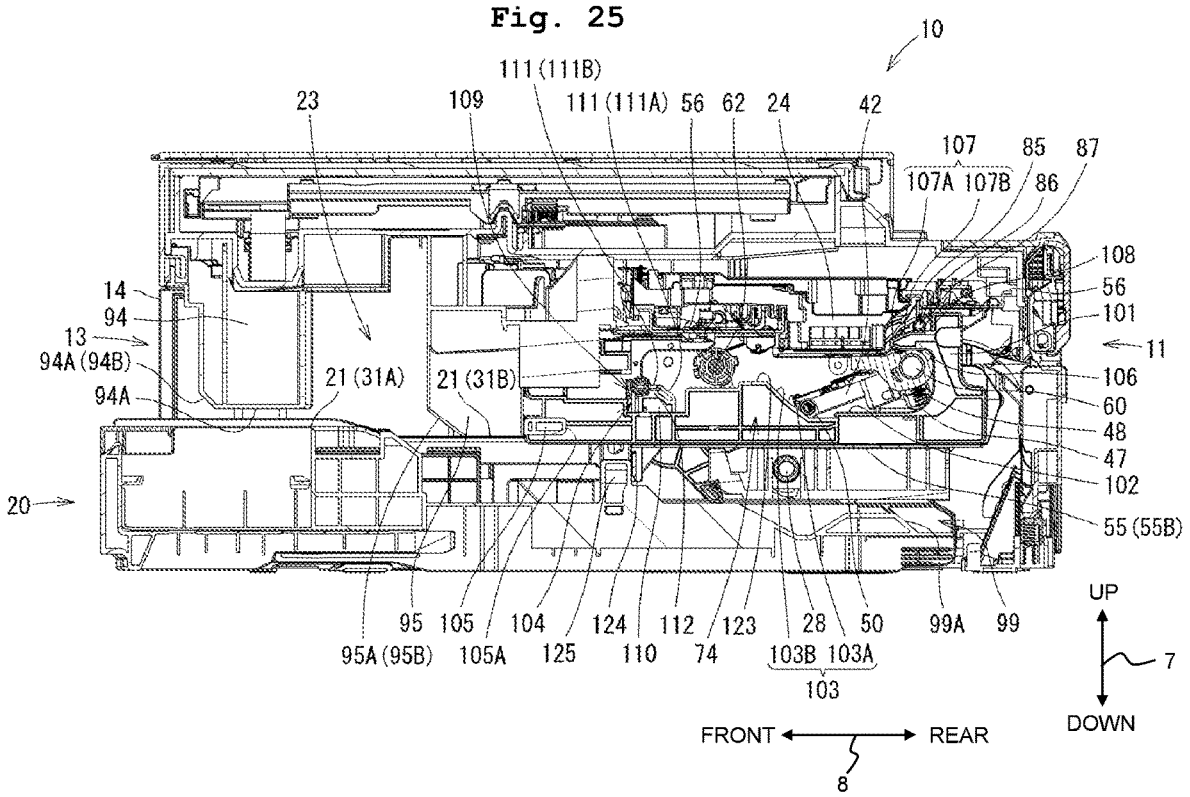
FIG. 25 is a vertical cross-sectional view depicting the printer part at a position at which the right side surface of the platen is viewed when the feed tray makes contact with the slide member from the front position.

When the feed tray 20 is moved further rearwardly after the contact of the inclined surface 99A of the feed tray 20 against the lever 75, and the feed tray 20 is inserted until arrival at the position depicted in FIGS. 23 to 25, then the projected part 125 of the feed tray 20 makes contact with the protrusion 124 of the slide member 74 from the front side as depicted in FIG. 24. In this situation, the front surface 96C of the cutout 96 of the feed tray 20 is positioned in front of the lever 75 located at the front rotation position indicated by the broken line in FIG. 24. Note that the lever 75 is actually positioned at the reference position in this situation. The lever 75 is not positioned at the front rotation position unless any contingent situation arises, for example, such that the lever 75 is caught by any foreign matter.

When the feed tray 20 is moved further rearwardly, the projected part 125 pushes the protrusion 124 rearwardly. Accordingly, the slide member 74 slides rearwardly from the front position, i.e., from the front position toward the rear position.

When the slide member 74 slides rearwardly, the projection 50 which is in the state of being supported by the lower inclined surface 103A (see FIG. 22), is guided along the lower inclined surface 103A (see FIG. 19). After that, the projection 50 is guided to the horizontal surface 123 by the aid of the upper inclined surface 103B (see FIG. 16). Accordingly, the platen 42 is rotated from the release position toward the printing position.

The projection 106 is separated from the shaft 87 when the projection 50 is guided by the upper inclined surface 103B, i.e., in the process in which the slide member 74 slides rearwardly from the position depicted in FIGS. 17 to 19 to the position depicted in FIGS. 14 to 16. Accordingly, the shaft 87 is biased by the coil spring 57, and the shaft 87 is moved downwardly. Accordingly, the roller holder 85 and the pinch roller 61 are also moved downwardly on account of own weights, and the pinch roller 61 makes contact with the conveying roller 60. As a result, the conveying roller pair 59 is changed from the separated state to the nipping state.

When the conveying roller pair 59 is changed to the nipping state, then the protrusion 104 of the slide member 74 is still separated from the projected part 49 of the platen 42, and the protrusion 104 does not support the projected part 49.

When the slide member 74 slides further rearwardly to arrive at a predetermined position after the conveying roller pair 59 is changed to the nipping state, then the protrusion 104 of the slide member 74 makes contact with the projected part 49 of the platen 42. The predetermined position is the position between the front position and the rear position. The projected part 49 is guided to the horizontal surface 111B by the aid of the inclined surface 111A of the forward end part 111 of the protrusion 104, and the projected part 49 is finally supported by the horizontal surface 111B of the forward end part 111. In this situation, the projected part 49 is biased upwardly and lifted by the forward end part 111 which functions as the plate spring, and the projected part 49 is pressed against the discharge roller 62. In other words, the projected part 49 is in the state of being vertically sandwiched or interposed by the protrusion 104 and the discharge roller 62. Accordingly, the forward end portion of the platen 42 is definitely positioned in the up-down direction 7 by the side frame 55 by which the discharge roller 62 is supported by the aid of the bearing 72. As a result, as for the platen 42, the forward end portion is also definitely positioned in addition to the rear end portion which is definitely positioned regardless of the position of the slide member 74. In this situation, the platen 42 (at the position depicted in FIGS. 11 to 13) is located at the printing position.

When the projected part 49 is lifted by the forward end part 111, the projection 50 is moved upwardly as well. Accordingly, the projection 50 is separated from the horizontal surface 123 of the slide member 74. In other words, when the platen 42 is located at the printing position, then the rear end portion and the front end portion thereof are definitely positioned vertically by the side frame 55, and the projection 50 is separated from the slide member 74.

As described above, the inclined surface 103 makes contact with the projection 50 of the platen 42 between the front position and the predetermined position to guide the platen 42 from the release position to the printing position. Further, the protrusion 104 makes contact with the projected part 49 of the platen 42 between the predetermined position and the rear position, and thus the platen 42 is guided to the printing position while separating the projection 50 from the inclined surface 103. Then, the protrusion 104 biases the projected part 49 toward the discharge roller 62 when the slide member 74 is located at the rear position.

Effects of Embodiment

In a case that the sheet 12 jammed between the recording part 24 and the platen 42 is taken out, the platen 42 is moved to the release position. In this situation, the conveyance roller pair 59 is in the separated state. Accordingly, it is possible to easily take out the sheet 12 jammed between the platen 42 and the recording part 24.

There is no need to provide a mechanism for separating the discharge roller 62 and the spur 63, constructing the discharge roller pair 44, from each other. Since the discharge roller pair 44 is located at a position closer to the internal space 23 and the opening 13 than the conveyance roller pair 59 and the platen 42, the sheet 12 can be easily taken out even if the discharge roller 62 and the spur 63 are not separated from each other.

Only by sliding the slide member 74, it is possible to change the state of the conveyance roller pair 59 and the moving of the platen 42.

In the case that the slider member 74 is slid, it is possible to distribute the load acting on the slide member 74 from the platen 42 and the load acting on the slide member 74 from the roller holder 85 and the shaft 87.

In a case that the roller holder 85 and the shaft 87 are guided to thereby change the state of the conveyance roller pair 59, there is such a fear that the posture of the sheet 12 pinched by the conveyance roller pair 59 and supported by the platen 42 might be changed and that the sheet 12 might make contact with the recording part 24. According to the present embodiment, the roller holder 85 and the shaft 87 are guided so as to change the state of the conveyance roller pair 59, after the moving of the platen 42 from the printing position to the release position is started and the distance between the platen 42 and the recording part 24 becomes large. Accordingly, even in a case that the posture of the sheet 12 is changed due to the change of the state of the conveyance roller pair 59, it is possible to lower such a possibility that the sheet 12 might make contact with the recording part 24.

If the moving of the platen 42 is completed before the change of the state of the conveyance roller pair 59 has been completed, then there is such a fear that the user might attempt to take out the sheet 12, assuming that the platen 42 is located at the release position, in a state that the conveyance roller pair is not allowed to be in the separated state. In such a case, there is such a fear that the load generated when the sheet 12 is being taken out might become large and/or that the sheet 12 might be broken or torn when the sheet 12 is being taken out. In the present embodiment, the moving of the platen 42 is completed after the change of the state of the conveyance roller pair 59 has been completed. Accordingly, when the user takes out the sheet 12, the conveyance roller pair 59 is allowed to be in the separated state. Thus, it is possible to lower such a possibility that the load generated when the sheet 12 is being taken out might become large and/or that the sheet 12 might be torn when the sheet 12 is (being) taken out.

In a case that the conveyance roller pair 59 is changed from the nipping state to the separated state, the biasing force of the coil spring 57 acting on the roller holder 85 and the shaft 87 becomes smaller as the pinch roller 61 is located closer to the conveyance roller 60. In the present embodiment, the inclination of the inclined surface 107 is made steep at a position at which the pinch roller 61 is close to the conveyance roller 60 (position at which the biasing force becomes small), thereby making it to possible to make a slid amount, of the slide member 74, for changing the conveyance roller pair 59 from the nipping state to the separated state, to be small, while suppressing any increase in the force required for guiding the roller holder 85 and the shaft 87.

The force acting on the inclined surface 107 from the roller holder 85 and the shaft 87 can be received by the side frames 55. Accordingly, it is possible to reduce any distortion or deformation of the inclined surface 107.

By only inserting and removing the feed tray 20 with respect to the casing 14, the slide member 74 is slid to thereby move the platen 42 and to change the state of the conveyance roller pair 59.

Since the projection 106 of the slide member 74 is located at the position different from the space in which the carriage 40 is movable, regardless of the positon of the slide member 74, it is possible to prevent any interference between the projection 106 and the carriage 40.

[Modifications]

In the embodiment described above, the lever 75 is biased to the reference position by the coil spring 115. However, the lever 75 may be biased to the reference position by the own weight.

In the embodiment described above, the forward end part 79 of the lever 75 is positioned under or below the shaft 76. However, the forward end part 79 of the lever 75 may be positioned over or above the shaft 76. In this case, the forward end 79A, which is disposed when the lever 75 is positioned at the front rotation position, is positioned frontwardly and downwardly as compared with when the lever 75 is positioned at the reference position. The forward end 79A, which is disposed when the lever 75 is positioned at the rear rotation position, is positioned rearwardly and downwardly as compared with when the lever 75 is positioned at the reference position.

The two levers 75 are provided corresponding to the provision of the two side walls 30 and the two slide members 74 of the feed tray 20. Then, usually, the amounts of rotation of the two levers 75 from the reference positions to the front rotation positions are identical with each other, and the amounts of rotation of the two levers 75 from the reference positions to the rear rotation positions are identical with each other. However, the amounts of rotation of the two levers 75 may be different from each other. For example, when the configurations of the two side walls 30 and the two slide members 74 differ between the left and the right, the amounts of rotation of the two levers 75 may be adjusted depending on the configurations. As a result, the amounts of rotation of the two levers 75 may be different from each other.

In the embodiment described above, the lever 75, which is located at the front rotation position, is regulated for the rotation in the orientation of the arrow 151 by making contact with the rear lower end part 70A of the third protrusion 70 of the base member 90 (see FIG. 21). However, it is also allowable to adopt such configuration that the lever 75, which is located at the front rotation position, may be further rotatable in the orientation of the arrow 151 by providing no third protrusion 70 of the base member 90 or by providing a position of the third protrusion 70 which is different from that provided in the embodiment described above.

In this case, when at least one of the lower surface 94A of the first protrusion 94 and the lower surface 95A of the second protrusion 95 is opposed in the up-down direction 7 to at least one of the front upper surface 31A of the discharge tray 21 and the horizontal surface 97A of the side wall 30 of the feed tray 20, it is desirable that the spacing distance in the up-down direction 7 between the opposing both is configured to be smaller than the spacing distance in the up-down direction 7 between the lever 75 at a limit rotation position and the feed tray 20.

In this context, the term "limit rotation position" means a position which is designated as the position brought about when the lever 75 is rotated in the maximum amount in the orientation of the arrow 151 from the reference position. For example, the limit rotation position is a position at which it is feared that the lever 75 and/or the coil spring 115 might be damaged, destroyed or broken if the lever 75 is rotated in the orientation of the arrow 151 while exceeding the limit rotation position. Further, for example, the limit rotation position is a certain position brought about when the lever 75 makes contact with the member for regulating the rotation at the certain position at which the lever 75 is rotated in the orientation of the arrow 151 while exceeding the front rotation position.

Figure 28:
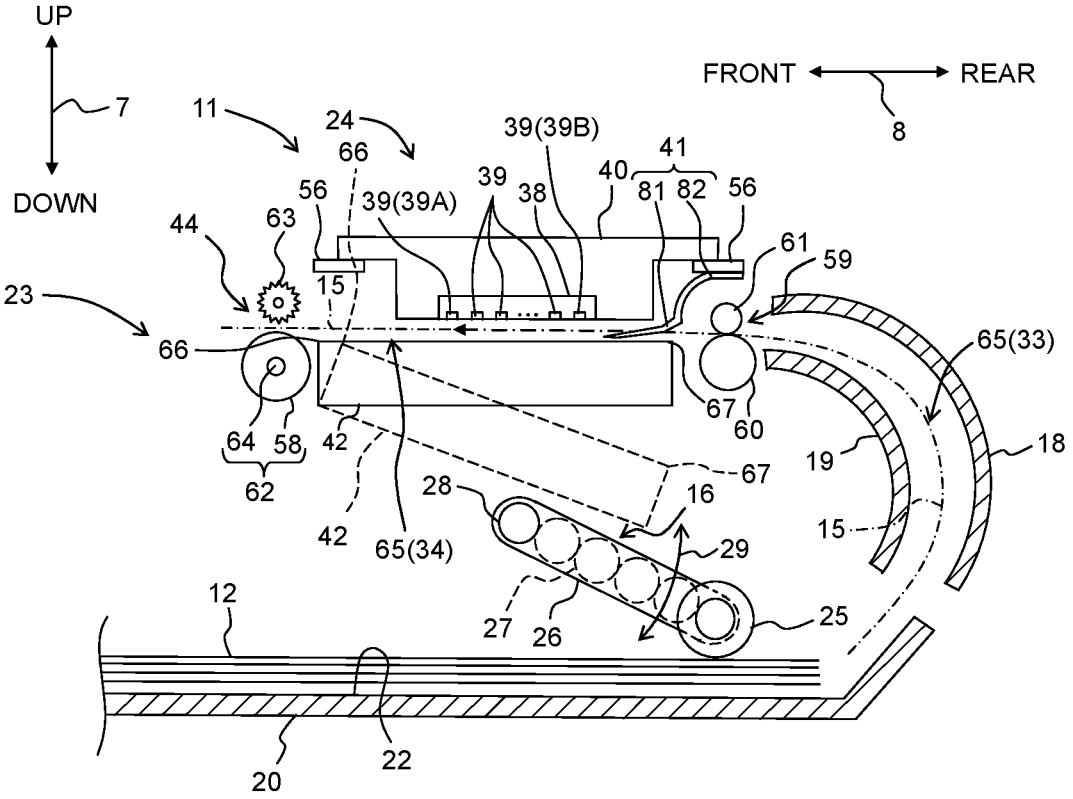
FIG. 28 is a vertical cross-sectional view schematically depicting the internal structure of a printer part in a modification.

The platen 42 may be rotated about any axis or shaft which is different from that of the conveying roller 60. For example, the platen 42 may be rotated about the axis of the pinch roller 61. Further, for example, as depicted in FIG. 28, the platen 42 may be rotated about the axis of the discharge roller 62. In this case, when the platen 42 is located at the release position, the rear end part 67 of the upper surface of the platen 42 (support surface for supporting the sheet 12) is positioned downwardly as compared with when the platen 42 is located at the printing position, as indicated by the broken line in FIG. 28.

Figure 29:
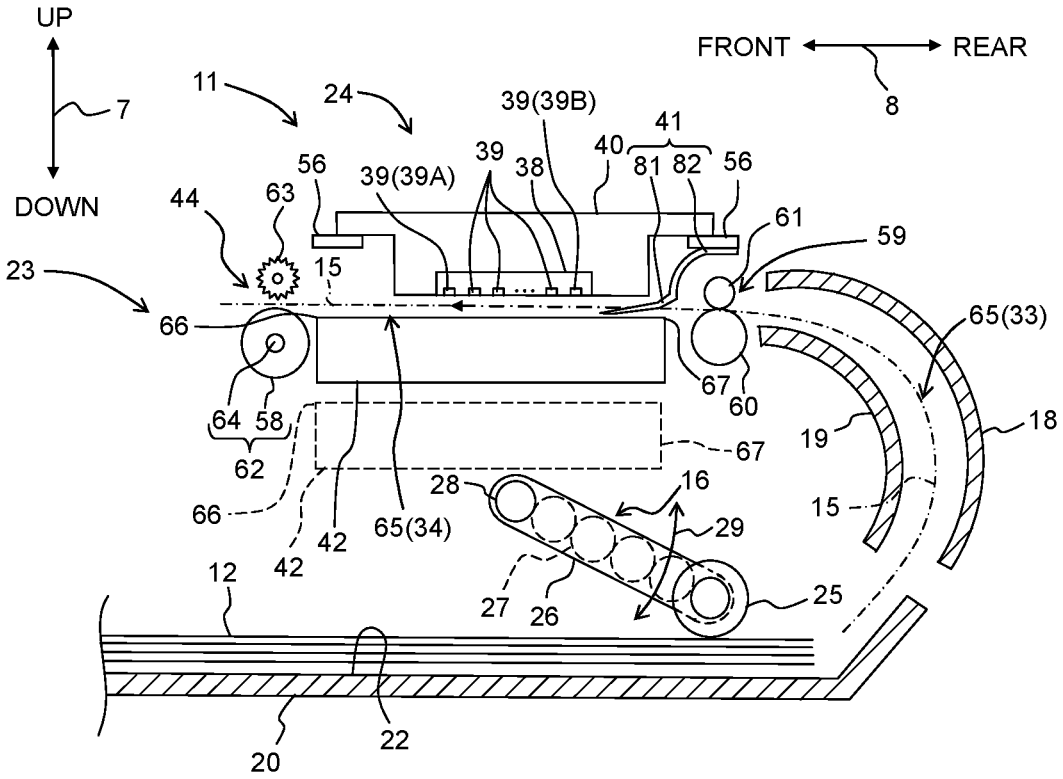
FIG. 29 is a vertical cross-sectional view schematically depicting the internal structure of a printer part in a modification.

The platen 42 may be moved to the printing position and the release position by any means which is different from the rotation, for example, by a slide (sliding movement) in the up-down direction 7 as depicted in FIG. 29. In this case, when the platen 42 is located at the release position, the platen 42 is positioned downwardly as compared with when the platen 42 is located at the printing position, as indicated by the broken line in FIG. 29. In other words, the front end part 66 and the rear end part 67 of the upper surface of the platen 42 are positioned downwardly as compared with when the platen 42 is located at the printing position.

In the embodiment described above, the conveying roller 60 is arranged under or below the straight part 34, and the pinch roller 61 is arranged over or above the straight part 34. However, conversely to the embodiment described above, the conveying roller 60 may be arranged over or above the straight part 34, and the pinch roller 61 may be arranged under or below the straight part 34. In this case, the slide member 74 is configured to move the pinch roller 61 downwardly by guiding the shaft 87 downwardly while being interlocked with the frontward movement. Further, in this case, the platen 42 is rotated about the axis of the pinch roller 61.

The projection 50 of the platen 42 depicted in FIGS. 6 and 8 may be rotatable about an axis extending in the left-right direction 9. In other words, the projection 50 may be a roller which is rotatably supported by the central part 162 of the platen 42.

A buffer material may be attached to the platen 42. The buffer material is, for example, a porous material such as a sponge, etc. For example, the plate member 83, which is composed of the metal in the embodiment described above, may be composed of a porous material in place of the metal. Thus, the plate member 83 functions as the buffer material. It is a matter of course that the platen 42 may be provided with the buffer material separately from the plate member 83 composed of the metal. In this case, when the platen 42 is located at the release position, the buffer material, instead of the plate member 83, makes contact with the surface 119 from the upper position, and thus the platen 42 at the release position is supported by the base member 90.

It is also allowable that the platen 42 is not provided with the ribs 43, 45. In this case, the support surface for the sheet 12 is the upper surface of the platen 42.

In the embodiment described above, when the feed tray 20 is withdrawn from the casing 14, then the lever 75, which makes contact with the feed tray 20 and which is rotated, makes contact with the slide member 74, and thus the slide member 74 slides from the rear position to the front position. When the feed tray 20 is inserted into the casing 14, then the feed tray 20 makes contact with the slide member 74, and thus the slide member 74 slides from the front position to the rear position without using the lever 75.

However, inversely to the above, the following configuration is also allowable. That is, when the feed tray 20 is inserted into the casing 14, then the lever 75, which makes contact with the feed tray 20 and which is rotated, makes contact with the slide member 74, and thus the slide member 74 slides from the front position to the rear position. When the feed tray 20 is withdrawn from the casing 14, then the feed tray 20 makes contact with the slide member 74, and thus the slide member 74 slides from the rear position to the front position without using the lever 75. In this case, it is preferable that the forward end part 79 of the lever 75 (portion of the lever 75 entering into the cutout 96) is positioned frontwardly as compared with the shaft 76 (in the case of the embodiment described above, the forward end part 79 is positioned rearwardly as compared with the shaft 76) when the lever 75 is positioned at the reference position.

Further, in both of the situations upon the insertion of the feed tray 20 into the casing 14 and upon the withdrawal of the feed tray 20 from the casing 14, the rotated lever 75, with which the feed tray 20 makes contact, may make contact with the slide member 74, and thus the slide member 74 may slide. Further, in both of the situations upon the insertion of the feed tray 20 into the casing 14 and upon the withdrawal of the feed tray 20 from the casing 14, the feed tray 20 may make contact with the slide member 74, and thus the slide member 74 may slide without using the lever 75.

Note that when the slide member 74 slides from the front position to the rear position by allowing the lever 75 to make contact with the slide member 74 upon the insertion of the feed tray 20 into the casing 14, the slide member 74 is provided with a projection 142 which projects or protrudes in the left-right direction 9 and which is located at the position at which the lever 75 makes the contact therewith from the front position, for example, as depicted by the broken line in FIG. 15.

In the embodiment described above, the platen 42 is moved to the printing position and the release position by allowing the slide member 74 to slide in the front-rear direction 8. However, the platen 42 may be moved to the printing position and the release position while being interlocked with the movement of any member which is different from the slide member 74.

Figure 26:
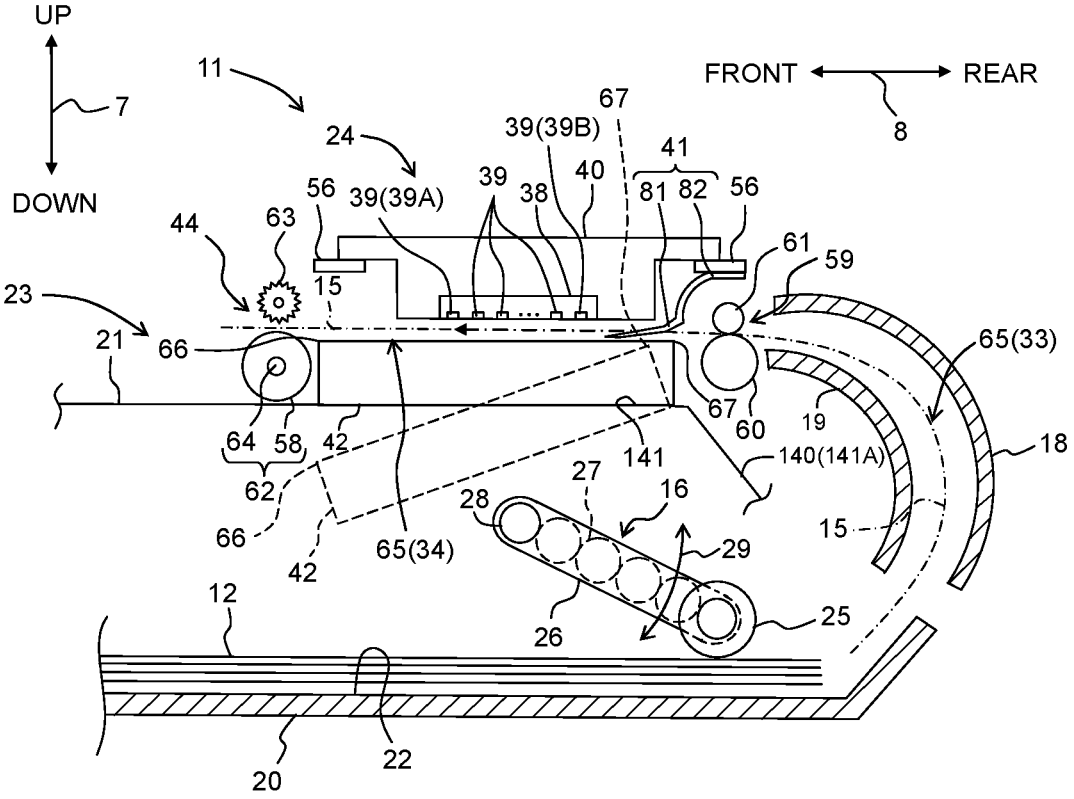
FIG. 26 is a vertical cross-sectional view schematically depicting the internal structure of a printer part in a modification.

For example, as depicted in FIG. 26, an upper surface 141 of a side wall 140 of the feed tray 20 may support the platen 42 located at the printing position. The side wall 140 corresponds to the side wall 30 of the feed tray 20 of the embodiment described above. An inclined surface 141A is formed at a rear end portion of the upper surface 141 of the side wall 140. The inclined surface 141A guides the forward end portion of the platen 42 downwardly in accordance with the frontward movement brought about when the feed tray 20 is withdrawn from the casing 14. Accordingly, the platen 42 is rotated from the printing position depicted by the solid line in FIG. 26 to the release position depicted by the broken line in FIG. 26 (position at which the forward end part 66 of the upper surface of the platen 42 (support surface for the sheet) is disposed downwardly as compared with when the platen 42 is located at the printing position). Further, the inclined surface 141A guides the forward end portion of the platen 42 upwardly in the process of the rearward movement brought about when the slide member 74 is inserted into the casing 14. Accordingly, the platen 42 is rotated from the release position to the printing position.

Further, for example, the upper surface of the discharge tray 21 may support the platen 42 at the printing position, and the platen 42 may be rotated to the printing position and the release position while being interlocked with the movement of the discharge tray 21. Note that the discharge tray 21 may be moved integrally with the feed tray 20 in the same manner as the embodiment described above, or the discharge tray 21 may be moved separately from the feed tray 20.

The material of the frame (side frame 55 and guide rail 56) is not limited to the metal. The material may be made of resin containing, as a main component thereof, a resin such as polyacetal (POM), etc.

It is also allowable that the printer part 11 is not provided with the contact member 41.

In the embodiment described above, the conveying passage 65 is configured by the curved part 33 and the straight part 34. However, the configuration of the conveying passage 65 is not limited to this. For example, the conveying passage 65 may be a generally straight passage which extends frontwardly from an opening formed on the rear surface of the casing 14 and which arrives at the internal space 23.

The printer part 11 of the embodiment described above is based on the so-called serial head system in which the recording part 24 is provided with the carriage 40. However, it is also allowable to adopt the so-called line head system in which the recording part 24 is not provided with the carriage 40, and the recording head 38 is provided to range from the left end to the right end of the conveying passage 65.

In the embodiment described above, the printer part 11 records an image on the sheet 12 in accordance with the ink-jet system. However, it is also allowable to record the image on the sheet 12 by means of any system other than the ink-jet system, for example, the electrophotography system.

What is claimed is:

1. An image recording apparatus comprising:

a casing having an internal space which is released to outside via an opening;

a conveying passage via which a sheet is conveyed and which is formed, inside the casing, at a position opposite to the opening with respect to the internal space;

a first roller pair which is positioned in the conveying passage, which has a driving roller and a driven roller following the driving roller, and which is configured to pinch the sheet and to convey the sheet in a conveying orientation toward the internal space;

a platen which is positioned, in the conveying passage, on a downstream side in the conveying orientation of the first roller pair, and which has a supporting surface supporting the sheet;

a recording part which is positioned above the platen and which is configured to record an image on the sheet supported by the platen;

a second roller pair which is positioned, in the conveying passage, on the downstream side in the conveying orientation of the supporting surface of the platen, and which is configured to pinch the sheet and to convey the sheet; and a moving mechanism configured to move the platen to a printing position and to a release positon, the printing positon being a position at which the platen is located under a condition that the image is recorded on the sheet by the recording part, and the release position being a position at which an end part, in the conveying orientation, of the supporting surface is positioned below a position of the end part at the printing position and a space between the platen and the recording part is communicated with the internal space via a gap between the end part and the second roller pair, wherein the first roller pair is configured to be changeable to a nipping state in which the driving roller and the driven roller make contact with each other, and to a separated state in which the driving roller and the driven roller are separated from each other, and the moving mechanism is configured to change the state of the first roller pair to the nipping state under a condition that the platen is at the printing position, and to change the state of the first roller pair to the separated state under a condition that the platen is at the release position.

2. The image recording apparatus according to claim 1, wherein under a condition that the platen is at the release position, rollers constructing the second roller pair make contact with each other.

3. The image recording apparatus according to claim 1, wherein the platen is moved to the printing position and to the release position by rotating about an axis of the driving roller or an axis of the driven roller.

4. The image recording apparatus according to claim 1, further comprising a tray which is configured to be inserted into the internal space in a first orientation via the opening and installed in the casing, which is configured to be removed from the casing by being pulled out in a second orientation opposite to the first orientation, and which is configured to support the sheet, wherein the conveying passage is constructed of a first path extending from the tray in the first orientation and upward and making U-turn in the second orientation, and a second path which is continuous with the first path and which extends in the second orientation and arrives at the internal space, and the platen, the recording part and the first roller pair are positioned in the second path.

5. The image recording apparatus according to claim 1, wherein the moving mechanism is provided with:

a slide member which is positioned inside the casing and which is slidable to a first position and to a second position which is located closer to the opening than the first position; and a roller supporting part which supports the driven roller to be rotatable, the slide member is provided with a first guide part and a second guide part, the first guide part is configured to make contact with the roller supporting part and to guide the roller supporting part in a sliding process from the first position to the second position so as to change the state of the first roller pair from the nipping state to the separated state, and configured to make contact with the roller supporting part and to guide the roller supporting part in a sliding process from the second position to the first position so as to change the state of the first roller pair from the separated state to the nipping state, and the second guide part is configured to make contact with the platen and to guide the platen from the printing position toward the release position in the sliding process from the first position to the second position, and configured to make contact with the platen and to guide the platen from the release position toward the printing position in the sliding process from the second position to the first position.

6. The image recording apparatus according to claim 5, wherein the platen is provided with a contacting part configured to make contact with a bearing of a roller constructing the second roller pair in a state that the platen is at the printing position, and in the sliding process of the slide member from the first position to the second position, guiding of the roller supporting part by the first guide part is started after the contacting part is separated and away from the bearing of the roller.

7. The image recording apparatus according to claim 5, wherein in the sliding process of the slide member from the first position to the second position, guiding of the roller supporting part by the first guide part is started after guiding of the platen by the second guide part is started.

8. The image recording apparatus according to claim 5, wherein in the sliding process of the slide member from the first position to the second position, moving of the platen is completed after the state of the first roller pair is completely changed.

9. The image recording apparatus according to claim 5, further comprising a biasing member configured to bias the driven roller to the driving roller, wherein the first guide part is provided with:

a first inclined surface which is inclined with respect to the supporting surface; and a second inclined surface which is continuous to the first inclined surface and which is inclined with respect to the supporting surface, the driven roller in a state that the first inclined surface makes contact with the roller supporting part, is located closer to the driving roller than the driven roller in a state that the second inclined surface makes contact with the roller supporting part, and an inclination angle of an obtuse angle formed by the first inclined surface with respect to the supporting surface is smaller than an inclination angle of an obtuse angle formed by the second inclined surface with respect to the supporting surface.

10. The image recording apparatus according to claim 5, wherein the driving roller is rotatably supported by a frame positioned in the internal space via a bearing of the driving roller, and in a state that the slide member is slid to the second position, the bearing of the driving roller is positioned immediately below the first guide part.

11. The image recording apparatus according to claim 5, further comprising a tray which is inserted to and pulled out from the casing via the opening and which is configured to support the sheet, wherein the slide member is configured to slide from the first position to the second position in conjunction with pulling of the tray out from the casing, and the sliding member is configured to slide from the second position to the first position in conjunction with insertion of the tray into the casing.

12. The image recording apparatus according to claim 5, wherein the recording part is provided with:

a head configured to discharge ink droplets; and a carriage having the head mounted thereon and movable along a scanning direction crossing the conveying orientation and an up-down direction, the slide member is provided with a projection having the second guide part, and the projection is located at a position different from a space in which the carriage is movable, regardless of a positon of the slide member.

* * * * *